US009190732B2

(12) United States Patent
Fujii et al.

(10) Patent No.: US 9,190,732 B2
(45) Date of Patent: Nov. 17, 2015

(54) ANTENNA DEVICE

(75) Inventors: Hirotaka Fujii, Kyoto-fu (JP); Eiichi Kobayashi, Kyoyo-fu (JP); Kaoru Sudo, Kyoto-fu (JP); Toshiro Hiratsuka, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 152 days.

(21) Appl. No.: 13/428,573

(22) Filed: Mar. 23, 2012

(65) Prior Publication Data

US 2012/0242547 A1 Sep. 27, 2012

(30) Foreign Application Priority Data

Mar. 23, 2011 (JP) ..... 2011-064391

(51) Int. Cl.

| | |
|---|---|
| ***H01Q 1/38*** | (2006.01) |
| ***H01Q 9/38*** | (2006.01) |
| ***H01Q 9/04*** | (2006.01) |
| ***H01Q 1/48*** | (2006.01) |

(52) U.S. Cl.

CPC ..... *H01Q 9/0414* (2013.01); *H01Q 1/38* (2013.01); *H01Q 1/48* (2013.01)

(58) Field of Classification Search

CPC . H01Q 9/0414; H01Q 9/0457; H01Q 5/0065; H01Q 19/005

USPC ..... 343/904, 905, 834, 846, 781 R, 833, 343/829, 817, 818

See application file for complete search history.

(56) References Cited

U.S. PATENT DOCUMENTS

| | | | | |
|---|---|---|---|---|
| 4,903,033 | A * | 2/1990 | Tsao et al. | 343/700 MS |
| 7,064,726 | B2 * | 6/2006 | Kitamori et al. | 343/771 |
| 7,339,532 | B2 | 3/2008 | Park et al. | |

(Continued)

FOREIGN PATENT DOCUMENTS

| | | | |
|---|---|---|---|
| JP | 55-093305 | A | 7/1980 |
| JP | H0427609 | U | 3/1992 |

(Continued)

OTHER PUBLICATIONS

An Office Action "Notification of Reason for Rejection" issued by the Japanese Patent Office on Apr. 30, 2013, which corresponds to Japanese Patent Application No. JP2011-064391 and is related to U.S. Appl. No. 13/428,573; with translation.

The first Office Action issued by the State Intellectual Property Office of People's Republic of China on Nov. 29, 2013, which corresponds to Chinese Patent Application No. 201210074447.4 and is related to U.S. Appl. No. 13/428,573; with English translation.

(Continued)

*Primary Examiner* — Dameon E Levi
*Assistant Examiner* — Ricardo Magallanes
(74) *Attorney, Agent, or Firm* — Studebaker & Brackett PC

(57) ABSTRACT

A chip antenna is mounted on a mother substrate including a feed line. In a representative embodiment, the chip antenna includes a laminated body including plural insulating layers, a radiating conductor element, a parasitic conductor element, a coupling adjusting conductor plate, and a LGA. The radiating conductor element is connected to the feed line via a first flat electrode pad of the LGA. On the other hand, the coupling adjusting conductor plate is provided between the radiating conductor element and the parasitic conductor element, and both end sides of the coupling adjusting conductor plate are connected to second and third flat electrode pads of the LGA. Another representative embodiment does not include a coupling adjusting conductor plate in the laminated body and includes an LGA that may or may not include second and third flat electrode pads.

17 Claims, 16 Drawing Sheets

(56) References Cited

U.S. PATENT DOCUMENTS

| | | | | |
|---|---|---|---|---|
| 7,619,568 | B2 * | 11/2009 | Gillette | 343/700 MS |
| 8,766,854 | B2 * | 7/2014 | Lin et al. | 343/700 MS |
| 2006/0192712 | A1 | 8/2006 | Park et al. | |
| 2010/0090903 | A1 * | 4/2010 | Byun et al. | 343/700 MS |

FOREIGN PATENT DOCUMENTS

| | | | |
|---|---|---|---|
| JP | 2001267833 | A | 9/2001 |
| JP | 2006238414 | A | 9/2006 |

OTHER PUBLICATIONS

The second Office Action issued by the State Intellectual Property Office of People's Republic of China on Aug. 18, 2014, which corresponds to Chinese Patent Application No. 201210074447.4 and is related to U.S. Appl. No. 13/428,573; with English translation.

The third Office Action issued by the State Intellectual Property Office of People's Republic of China on Dec. 23, 2014, which corresponds to Chinese Patent Application No. 201210074447.4 and is related to U.S. Appl. No. 13/428,573; with English translation.

* cited by examiner

ANTENNA DEVICE

CROSS REFERENCE TO RELATED APPLICATIONS

The present application claims priority to Japanese Patent Application No. 2011-064391 filed on Mar. 23, 2011, the entire contents of which is incorporated herein by reference.

FIELD OF THE INVENTION

The present invention relates to an antenna device suitably used for high frequency signals such as microwave and millimeter wave signals, for example.

BACKGROUND

As an example of antenna device according to the related art, there is a microstrip antenna (patch antenna) in which a radiating conductor element and a ground conductor plate are provided facing each other across a dielectric that is thin relative to wavelength, and a parasitic conductor element is provided on the radiating surface side of the radiating conductor element. See, for example, Japanese Unexamined Patent Application Publication No. 55-93305.

The antenna device according to Japanese Unexamined Patent Application Publication No. 55-93305 achieves bandwidth enhancement by exploiting magnetic coupling between the radiating conductor element and the parasitic conductor element.

SUMMARY

The present disclosure provides an antenna device that can provide desired antenna characteristics over a wide frequency range.

In one aspect of the disclosure, an antenna device includes a mother substrate including a feed line and a ground, and a chip antenna mounted on the mother substrate. The chip antenna includes a laminated body including a plurality of insulating layers that are laminated together; a radiating conductor element located inside the laminated body, sandwiched between two of the insulating layers, and connected to the feed line of the mother substrate; a parasitic conductor element that is located more toward a front side of the laminated body with respect to the radiating conductor element, and is insulated from the radiating conductor element; a coupling adjusting conductor plate that is placed between the parasitic conductor element and the radiating conductor element, and adjusts an amount of coupling between the parasitic conductor element and the radiating conductor element; and a land grid array provided on a back side of the laminated body and including a plurality of flat electrode pads, the flat electrode pads including a first flat electrode pad, a second flat electrode pad, and a third flat electrode pad. The coupling adjusting conductor plate partially covers an area where the parasitic conductor element and the radiating conductor element overlap each other when viewed in a thickness direction of the laminated body, and straddles the radiating conductor element in a direction orthogonal to a direction of a current that flows in the radiating conductor element. The radiating conductor element is connected to the feed line of the mother substrate via the first flat electrode pad of the land grid array. Both end sides of the coupling adjusting conductor plate are connected to the ground of the mother substrate via the second flat electrode pad and the third flat electrode pad of the land grid array.

In a more specific embodiment, connection between the both end sides of the coupling adjusting conductor plate, and the second flat electrode pad and the third flat electrode pad of the land grid array may be made by using a columnar conductor that extends in a thickness direction of the laminated body.

In another more specific embodiment, the feed line may include a strip line, where the strip line includes a frontside ground conductor plate provided on a front side of the mother substrate and including a connecting aperture, a backside ground conductor plate provided on a back side of the mother substrate, and a strip conductor provided between the frontside ground conductor plate and the backside ground conductor plate, the strip conductor is connected to the first flat electrode pad via the connecting aperture, and the frontside ground conductor plate is connected to the second flat electrode pad and the third flat electrode pad.

In another more specific embodiment, the feed line may include a grounded coplanar line, where the grounded coplanar line includes a frontside ground conductor plate provided on a front side of the mother substrate, a backside ground conductor plate provided on a back side of the mother substrate, a gap including a linear shape that is formed in the frontside ground conductor plate, and a strip conductor provided in the gap and extending along a length direction of the gap, the strip conductor is connected to the first flat electrode pad, and the frontside ground conductor plate is connected to the second flat electrode pad and the third flat electrode pad.

In yet another more specific embodiment, the antenna device may further include two ground electrode pads provided on a front side of the mother substrate, the feed line includes a microstrip line, the microstrip line including a backside ground conductor plate provided on a back side of the mother substrate, and a strip conductor provided on the front side of the mother substrate, the strip conductor is connected to the first flat electrode pad, and the backside ground conductor plate is connected to the second flat electrode pad and the third flat electrode pad via the two ground electrode pads.

In still another more specific embodiment, the radiating conductor element, the parasitic conductor element, and the coupling adjusting conductor plate may be provided at positions different from each other with respect to a thickness direction of the laminated body.

In another aspect of the disclosure, an antenna device includes a mother substrate including a feed line and an electrode, and a chip antenna mounted on the mother substrate. The chip antenna includes a laminated body including a plurality of insulating layers that are laminated together; a radiating conductor element located inside the laminated body and sandwiched between two of the insulating layers, the radiating conductor element being connected to the feed line of the mother substrate; a parasitic conductor element that is located more toward a front side of the laminated body with respect to the radiating conductor element, and is insulated from the radiating conductor element; and a land grid array provided on a back side of the laminated body and including a plurality of flat electrode pads, the flat electrode pads including a first flat electrode pad and a flat electrode pad other than the first flat electrode pad. The radiating conductor element is connected to the feed line of the mother substrate via the first flat electrode pad of the land grid array. The flat electrode pad of the land grid array is joined to the electrode of the mother substrate.

Other features, elements, and characteristics, and advantages will become more apparent from the following detailed description with reference to the attached drawings.

DETAILED DESCRIPTION

Figure 1:
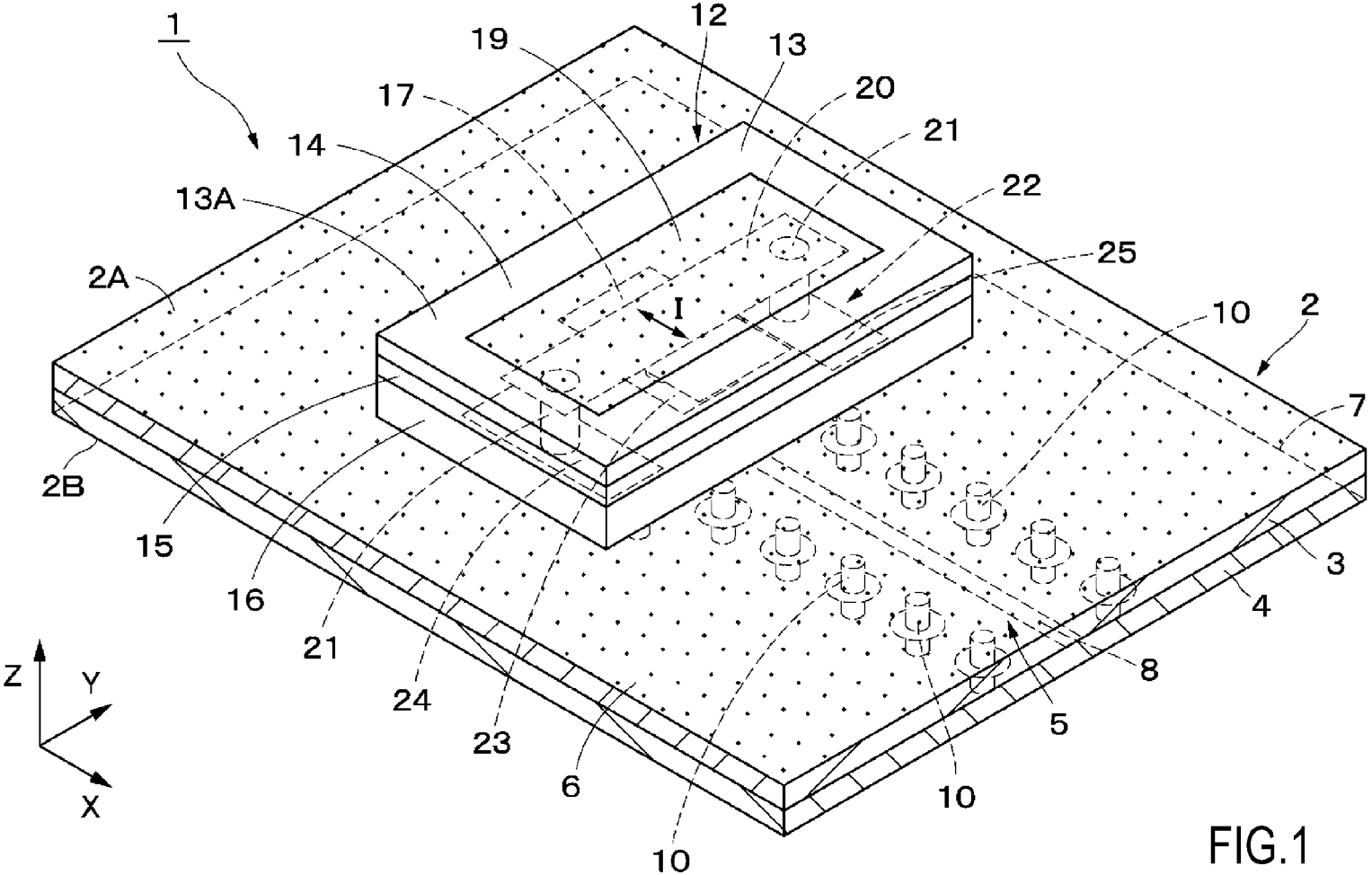
FIG. 1 is a perspective view illustrating an antenna device according to a first exemplary embodiment.
Figure 2:
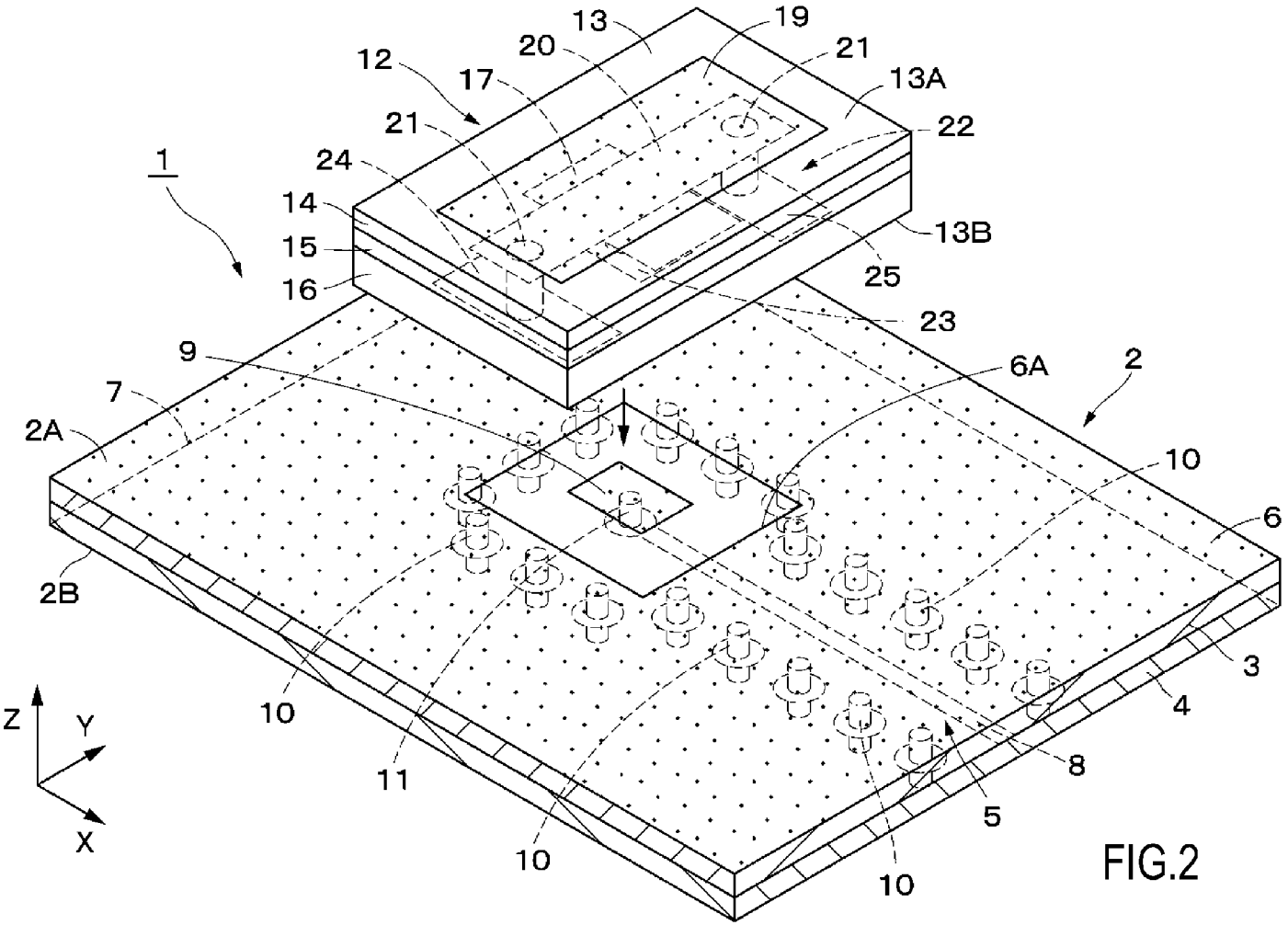
FIG. 2 is a perspective view illustrating a state in which a mother substrate and a chip antenna in FIG. 1 are separated from each other.

The inventors realized that in the antenna device according to Japanese Unexamined Patent Application Publication No. 55-93305, because the dimension of distance in the thickness direction between the radiating conductor element and the parasitic conductor element contributes greatly to the magnitude of electromagnetic coupling, there is a limit to bandwidth enhancement.

Additionally, in the antenna device according to Japanese Unexamined Patent Application Publication No. 55-93305, electric power is fed by using an input terminal configured by a connector or the like. However, the inventors realized in the case of using such an antenna for the millimeter wave band, the outer shape of the antenna becomes as small as about several mm, making it difficult to feed electric power by using a connector. Accordingly, the antenna is directly connected to a feed line. At this time, loss of matching tends to occur at the joint between the antenna and the feed line, and antenna characteristics such as reflectivity and antenna gain tend to deteriorate.

A conceivable way to enhance the matching between the antenna and the feed line is to, for example, form the antenna and the feed line integrally on a multi-layer substrate. However, in order to make loss of electromagnetic waves small, a material with low dielectric loss tangent (tan δ) is required as the insulating material used for the antenna. However, a material having such property (for example, a ceramic material) is expensive in comparison to a common insulating material (for example, a resin material). Therefore, manufacturing cost tends to increase in the case where the antenna and the feed line are integrated together Hereinafter, an antenna device according to an exemplary embodiment as applied to, for example, a patch antenna for use in the 60 GHz band is described in detail with reference to the attached drawings.

FIGS. 1 to 5 illustrate an antenna device 1 according to a first exemplary embodiment. The antenna device 1 is formed by mounting a chip antenna 12 on a mother substrate 2 described later.

The mother substrate 2 is formed in a substantially flat shape that extends in parallel to, for example, the X-axis direction and the Y-axis direction among the X-axis, Y-axis, and Z-axis directions that are mutually orthogonal. The mother substrate 2 has a width dimension of about several mm, for example, with respect to the Y-axis direction that serves as the width direction, and has a length dimension of about several mm, for example, with respect to the X-axis direction that serves as the length direction. The mother substrate 2 also has a thickness dimension of about several hundred μm, for example, with respect to the Z-axis direction that serves as the thickness direction.

The mother substrate 2 has two insulating layers 3 and 4. The insulating layers 3 and 4 are formed by using an insulating resin material, for example, and laminated in the Z-axis direction from a front side 2A toward a back side 2B of the mother substrate 2. The mother substrate 2 is provided with a strip line 5.

As illustrated in FIGS. 1 to 5, the strip line 5 forms a feed line for feeding electric power to a radiating conductor element 17 of the chip antenna 12. The strip line 5 includes a frontside ground conductor plate 6 provided on the front side 2A of the mother substrate 2, a backside ground conductor plate 7 provided on the back side 2B of the mother substrate 2, and a strip conductor 8 located between the frontside ground conductor plate 6 and the backside ground conductor plate 7 and sandwiched between the insulating layers 3 and 4.

The frontside ground conductor plate 6 is formed by, for example, a thin film using a conductive metallic material such as copper or silver, and is connected to the ground. The frontside ground conductor plate 6 covers substantially the entire front side 2A of the mother substrate 2.

In the central portion of the frontside ground conductor plate 6, for example, a substantially rectangular connecting aperture 6A is provided in order to connect the radiating conductor element 17 and the strip conductor 8. The connecting aperture 6A is a substantially oblong aperture having a length dimension L1 in the X-axis direction, and a width dimension L2 in the Y-axis direction. The connecting aperture 6A has a larger area than the radiating conductor element 17. Therefore, the length dimension L1 and width dimension L2 of the connecting aperture 6A are set to values larger than the length dimension L3 and width dimension L4 of the radiating conductor element 17, respectively.

A feed electrode pad 9 having a substantially rectangular shape is provided in the central portion of the connecting aperture 6A. The feed electrode pad 9 is formed in substantially the same size and shape as a first flat electrode pad 23 of the chip antenna 12 which is described later, for example. Also, the feed electrode pad 9 is formed with an area smaller than the radiating conductor element 17, for example. In order to reduce variations in antenna characteristics due to misalignment or the like occurring when joining the mother substrate 2 and the chip antenna 12 together, it is preferable to make the area of the connecting aperture 6A as large as possible.

In substantially the same manner as the frontside ground conductor plate 6, the backside ground conductor plate 7 is formed by using a conductive metallic material, and is connected to the ground. The backside ground conductor plate 7 covers substantially the entire back side 2B of the mother substrate 2.

The backside ground conductor plate 7 is electrically connected to the frontside ground conductor plate 6 by a plurality of via-holes 10. The via-holes 10 are each formed as a substantially cylindrical conductor by providing a through-hole penetrating the insulating layers 3 and 4 and having an inside diameter of about several ten to several hundred μm with, for example, a conductive metallic material such as copper or silver. The via-holes 10 extend in the Z-axis direction and the both ends of the via-holes 10 are connected to the frontside ground conductor plate 6 and the backside ground conductor plate 7 respectively. The via-holes 10 are placed on both sides in the width direction of the strip conductor 8 so as to surround the strip conductor 8, and are placed along the outer edges of the connecting aperture 6A so as to surround the connecting aperture 6A. Thus, the via-holes 10 serve to stabilize the potential of the ground conductor plates 6 and 7, and suppress leakage of the high frequency signal that propagates through the strip conductor 8.

On the other hand, the strip conductor 8 can be made of, for example, substantially the same conductive metallic material as the frontside ground conductor plate 6. The strip conductor 8 is formed substantially in the shape of a narrow strip extending in the X-axis direction, and is placed between the insulating layer 3 and the insulating layer 4. An end of the strip conductor 8 is placed in the center portion of the connecting aperture 6A, and is connected to the radiating conductor element 17 via a via-hole 11 serving as a connecting line and the feed electrode pad 9.

The via-hole 11 is formed as a substantially cylindrical conductor in substantially the same manner as the via-holes 10. The via-hole 11 is formed penetrating the insulating layer 3, and extends in the Z-axis direction through the center portion of the connecting aperture 6A. The ends of the via-hole 11 are respectively connected to the strip conductor 8 and the feed electrode pad 9. The strip line 5 is formed in line symmetry with respect to a line passing through the center position in the width direction and parallel to the X-axis.

As illustrated in FIGS. 1 to 8, the chip antenna 12 includes a laminated body 13, the radiating conductor element 17, a parasitic conductor element 19, a coupling adjusting conductor plate 20, and a land grid array 22 (hereinafter, referred to as LGA 22).

The laminated body 13 can be formed by using, for example, a low temperature co-fired ceramic (LTCC) as a material with a low dielectric loss tangent in comparison to the mother substrate 2. The laminated body 13 has three insulating layers 14 to 16 that are laminated together in the Z-axis direction from its front side 13A toward its back side 13B. Each of the insulating layers 14 to 16 can be made of an insulating ceramic material that can be fired at low temperatures of not higher than 1000° C., can have a relative dielectric constant of, for example, about 6 to 10, and can be formed in a thin layer form. Each of the insulating layers 14 to 16 can have, for example, a length dimension of about several hundred μm to several mm in the X-axis dimension, and a width dimension of about several hundred μm to several mm in the Y-axis dimension. Also, each of the insulating layers 14 to 16 is formed in a substantially oblong or elongated shape whose short side is along the X-axis direction and whose long side is along the Y-axis direction. Thus, the laminated body 13 in the present embodiment is formed in a substantially rectangular parallelepiped shape.

The radiating conductor element 17 can be formed in a substantially rectangular shape by using a conductive metallic material such as copper or silver, for example. The radiating conductor element 17 faces the connecting aperture 6A of the frontside ground conductor plate 6 at a distance. The radiating conductor element 17 is placed between the insulating layer 15 and the insulating layer 16. Therefore, the insulating layer 16 is placed between the radiating conductor element 17 and the frontside ground conductor plate 6. The radiating conductor element 17 is formed with an area smaller than the connecting aperture 6A. Therefore, when the chip antenna 12 as joined to the mother substrate 2 is seen in plan view, the radiating conductor element 17 is placed inside the connecting aperture 6A.

Figure 3:
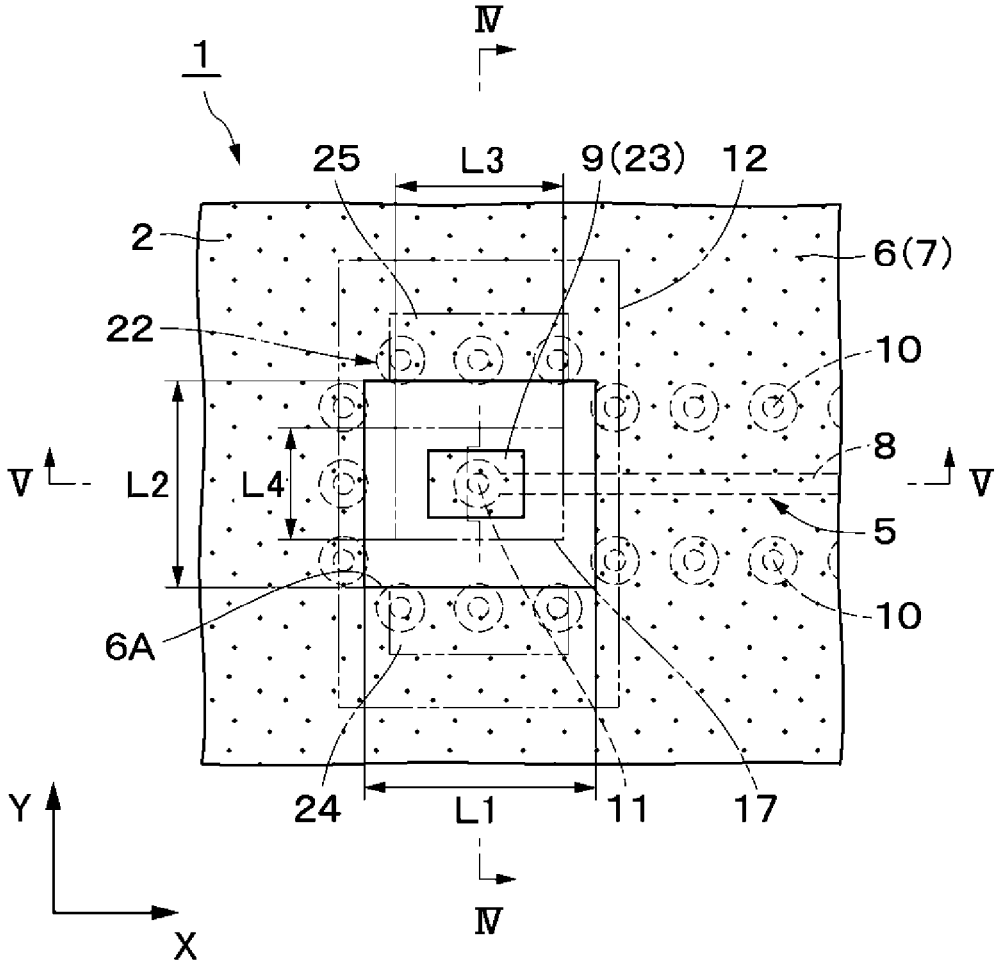
FIG. 3 is a plan view illustrating the main part of the antenna device.
Figure 4:
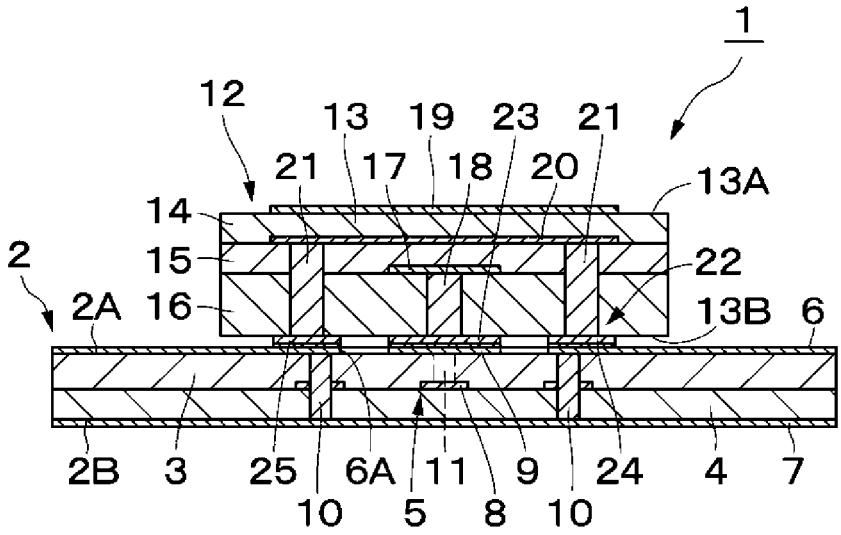
FIG. 4 is a cross-sectional view of the antenna device taken along an arrow IV-IV in FIG. 3.
Figure 5:
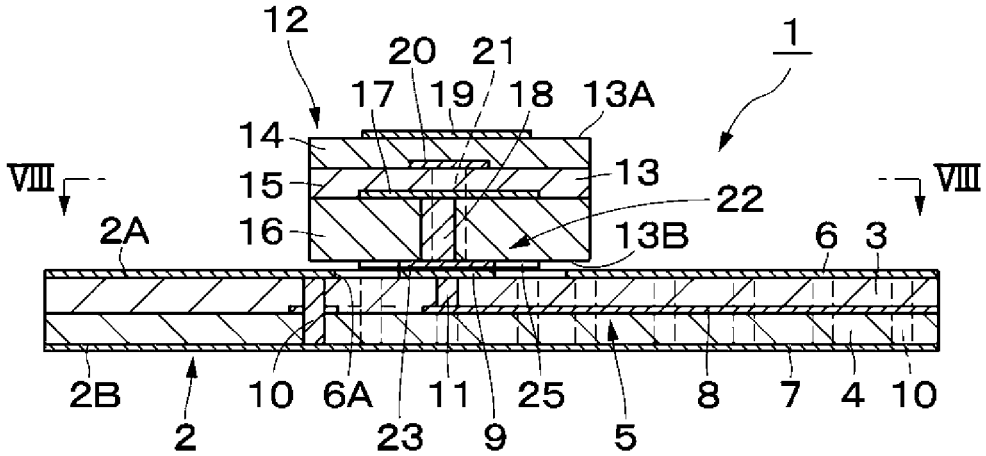
FIG. 5 is a cross-sectional view of the antenna device taken along an arrow V-V in FIG. 3.

As illustrated in FIG. 3, the radiating conductor element 17 can have the length dimension L3 of, for example, about several hundred μm in the X-axis direction, and can have the width dimension L4 of, for example, about several hundred μm in the Y-axis direction. The length dimension L3 in the X-axis direction of the radiating conductor element 17 can be set to a value that is substantially one-half wavelength in electrical length of the high frequency signal used, for example.

Further, a via-hole 18 is connected to the radiating conductor element 17 at some midpoint in the X-axis direction. Also, the first flat electrode pad 23, described later, is connected to the radiating conductor element 17 via the via-hole 18. The via-hole 18 is placed so as to be shifted from the middle position of the radiating conductor element 17 with respect to the X-axis direction, for example, and is formed as a substantially cylindrical conductor in substantially the same manner as the via-holes 10. The via-hole 18 penetrates the insulating layer 16, and is electrically connected to the strip conductor 8 via the first flat electrode pad 23 and the like. Thus, in the radiating conductor element 17, an electric current I flows in the X-axis direction as electric power is fed from the strip line 5.

The parasitic conductor element 19 can be formed in a substantially rectangular shape by using substantially the same conductive metallic material as the radiating conductor element 17, for example. The parasitic conductor element 19 is located opposite to the joint surface (back side 13B) of the laminated body 13 with the mother substrate 2 as viewed from the radiating conductor element 17, and is placed on the front side 13A of the laminated body 13 (the front side of the insulating layer 14). The insulating layers 14 and 15 are placed between the parasitic conductor element 19 and the radiating conductor element 17. Therefore, the parasitic conductor element 19 faces the radiating conductor element 17 at a distance while being insulated from the radiating conductor element 17 and the frontside ground conductor plate 6.

Figure 7:
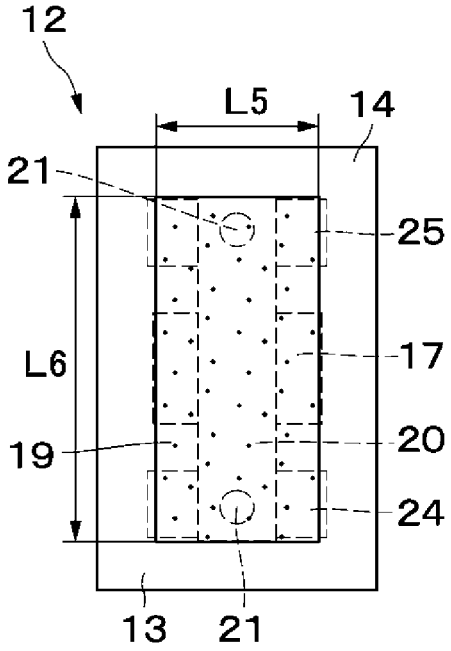
FIG. 7 is a plan view illustrating the chip antenna in FIG. 1.

As illustrated in FIG. 7, the parasitic conductor element 19 can have a length dimension L5 of, for example, about several hundred μm in the X-axis direction, and can have a width dimension L6 of, for example, about several hundred μm in the Y-axis direction. The width dimension L6 of the parasitic conductor element 19 can be larger than the width dimension L4 of the radiating conductor element 17, for example. On the other hand, the length dimension L5 of the parasitic conductor element 19 can be smaller than the length dimension L3 of the radiating conductor element 17, for example. The relative sizes and specific shapes of the parasitic conductor element 19 and the radiating conductor element 17 are not limited to those mentioned above but are set as appropriate by taking the radiation pattern of the chip antenna 12 and the like into consideration. The parasitic conductor element 19 produces electromagnetic coupling with the radiating conductor element 17.

The coupling adjusting conductor plate 20 can be formed in a substantially rectangular shape by using substantially the same conductive metallic material as the radiating conductor element 17, for example. The coupling adjusting conductor plate 20 is placed between the radiating conductor element 17 and the parasitic conductor element 19. Specifically, the coupling adjusting conductor plate 20 is placed between the insulating layer 14 and the insulating layer 15, and is insulated from the radiating conductor element 17 and the parasitic conductor element 19.

Figure 8:
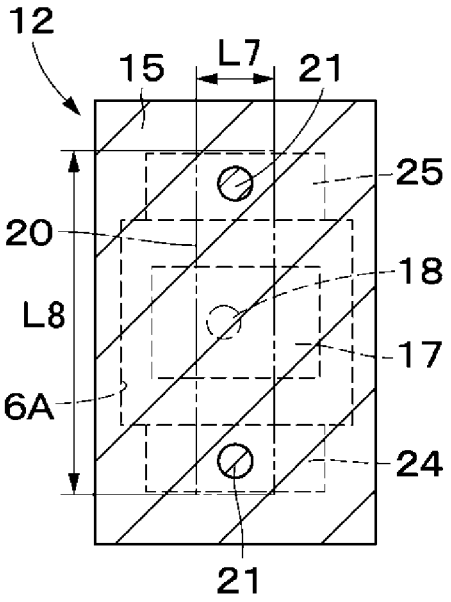
FIG. 8 is a cross-sectional view of the chip antenna taken along an arrow VIII-VIII in FIG. 5.

As illustrated in FIG. 8, the coupling adjusting conductor plate 20 can have a length dimension L7 of, for example, about several hundred μm in the X-axis direction, and can have a width dimension L8 of, for example, about several hundred μm in the Y-axis direction. The width dimension L8 of the coupling adjusting conductor plate 20 can be, for example, larger than the width dimension L4 of the radiating conductor element 17, and can be set to about the same value as the width dimension L6 of the parasitic conductor element 19. On the other hand, the length dimension L7 of the coupling adjusting conductor plate 20 can be, for example, smaller than the length dimension L3 of the radiating conductor element 17 and the length dimension L5 of the parasitic conductor element 19. Therefore, the coupling adjusting conductor plate 20 crosses and covers a center portion (for example, a center portion in the X-axis direction) that is a part of the area where the radiating conductor element 17 and the parasitic conductor element 19 overlap each other, in the Y-axis direction. Thus, the coupling adjusting conductor plate 20 straddles the radiating conductor element 17 in a direction orthogonal to the direction of the current I that flows in the radiating conductor element 17.

A pair of via-holes 21 are provided at the both sides of the coupling adjusting conductor plate 20. The via-holes 21 are each formed as a substantially cylindrical conductor in substantially the same manner as the via-holes 10. The via-holes 21 are formed penetrating the insulating layers 15 and 16, and electrically connect the coupling adjusting conductor plate 20 and the second and third flat electrode pads 24 and 25 to each other.

The radiating conductor element 17, the parasitic conductor element 19, and the coupling adjusting conductor plate 20 are placed in such a way that their center positions are located at substantially the same position in the XY-plane, for example. Also, the radiating conductor element 17, the parasitic conductor element 19, and the coupling adjusting conductor plate 20 are formed in line symmetry with respect to a line passing through their center positions and parallel to the X-axis, and are formed in line symmetry with respect to a line passing through their center positions and parallel to the Y-axis. The coupling adjusting conductor plate 20 adjusts the amount of coupling between the radiating conductor element 17 and the parasitic conductor element 19.

Figure 6:
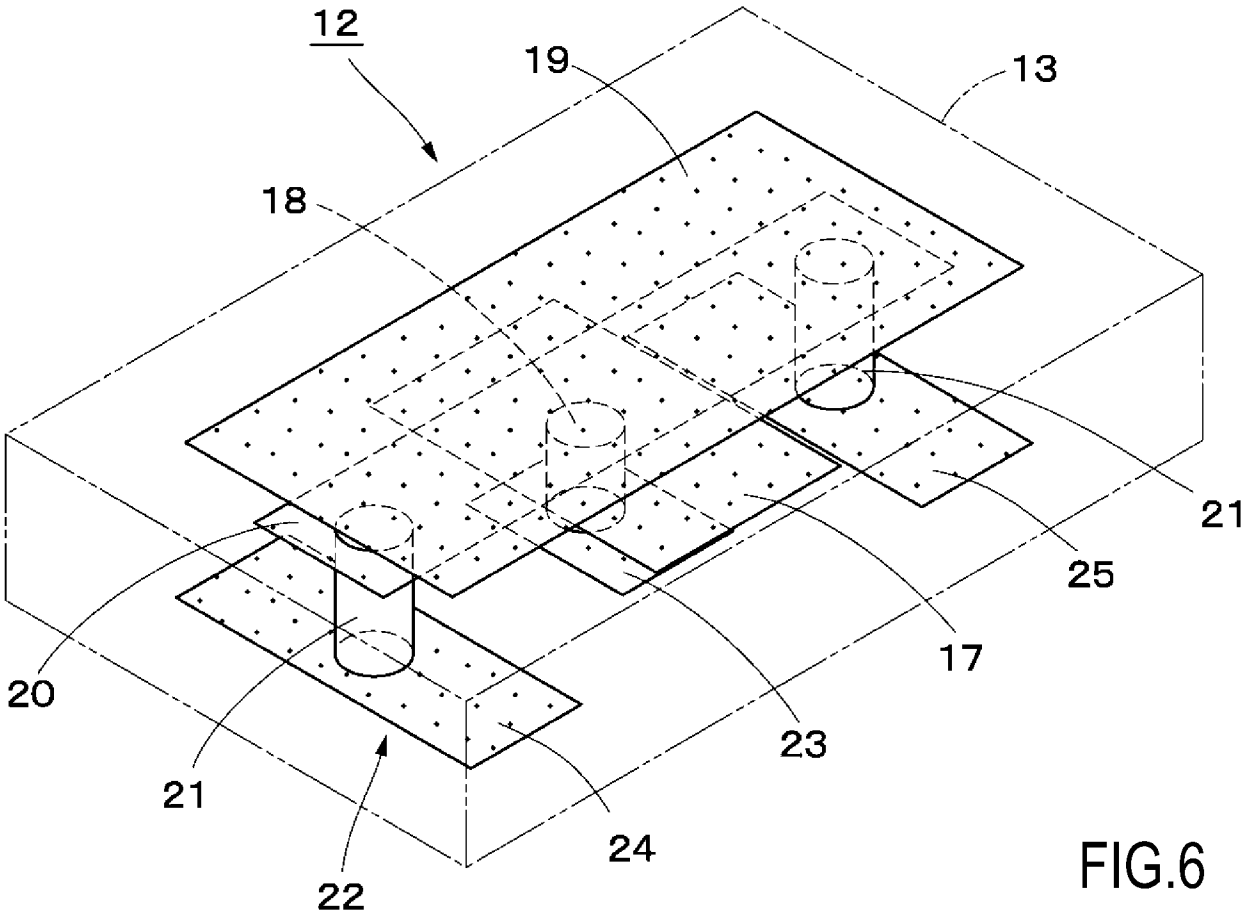
FIG. 6 is a perspective view illustrating the chip antenna in FIG. 1 alone.

As illustrated in FIGS. 1 and 6, the LGA 22 includes the first to third flat electrode pads 23 to 25, and is provided on the back side 13B of the laminated body 13. The first flat electrode pad 23 is provided in the central portion of the back side 13B. The first flat electrode pad 23 has substantially the same size as the feed electrode pad 9, and is formed in substantially the same rectangular shape as the feed electrode pad 9. Therefore, the first flat electrode pad 23 is formed with an area smaller than the radiating conductor element 17.

On the other hand, the second and third flat electrode pads 24 and 25 are placed on both sides in the Y-axis direction across the first flat electrode pad 23. The second and third flat electrode pads 24 and 25 are formed in a substantially oblong or elongated shape whose long side is along the X-axis direction and whose short side is along the Y-axis direction. The second and third flat electrode pads 24 and 25 are spaced apart from each other in the Y-axis direction with substantially the same dimension of distance as the width dimension L2 of the connecting aperture 6A. Therefore, among the long sides of the second and third flat electrode pads 24 and 25, those long sides which are located close to the first flat electrode pad 23 extend in the X-axis direction along the outer edges of the connecting aperture 6A.

Thus, when joining the chip antenna 12 to the mother substrate 2 by reflow soldering or the like, for example, a self-alignment effect is exerted among the first to third flat electrode pads 23 to 25, the feed electrode pad 9, and the frontside ground conductor plate 6. As a result, the center of the first flat electrode pad 23 substantially coincides with the center of the feed electrode pad 9. Also, the long sides of the second and third flat electrode pads 24 and 25 are aligned substantially in parallel to the portion of the connecting aperture 6A which extends in the X-axis direction.

The length dimension of the long (elongated) sides of the second and third flat electrode pads 24 and 25 can be set to, for example, about the same value as the length dimension L3 of the radiating conductor element 17, and can be set to a value smaller than the length dimension L1 of the connecting aperture 6A. Further, the first to third flat electrode pads 23 to 25 can be formed in line symmetry with respect to a line passing through the center position of the first flat electrode pad 23 and parallel to the X-axis, and can also be formed in line symmetry with respect to a line passing through the center position of the first flat electrode pad 23 and parallel to the Y-axis.

The first to third flat electrode pads 23 to 25 are provided to face the feed electrode pad 9 and the edge portion of the connecting aperture 6A of the frontside ground conductor plate 6, and are joined to the feed electrode pad 9 and the frontside ground conductor plate 6 by a method of joining such as soldering, for example. Thus, the chip antenna 12 is joined and fixed to the mother substrate 2. Also, the first flat electrode pad 23 is electrically connected to the feed electrode pad 9, and the second and third flat electrode pads 24 and 25 are electrically connected to the frontside ground conductor plate 6.

The antenna device 1 according to this exemplary embodiment is configured as mentioned above. Next, the operation of the antenna device 1 will be described.

First, when electric power is fed from the strip line 5 toward the radiating conductor element 17, the current I flows in the radiating conductor element 17 along the X-axis direction. Thus, the chip antenna 12 transmits or receives a high frequency signal according to the length dimension L3 of the radiating conductor element 17.

At this time, the radiating conductor element 17 and the parasitic conductor element 19 are electromagnetically coupled to each other, and have two resonance modes with different resonant frequencies. The return loss of high frequency signals decreases at these two resonant frequencies. In addition, the return loss of high frequency signals decreases also in the frequency range between these two resonant frequencies. Therefore, the usable frequency range for high frequency signals increases as compared with the case where the parasitic conductor element 19 is omitted.

As the distance dimension between the parasitic conductor element 19 and the radiating conductor element 17 becomes larger, the frequency range over which the strip line 5 and the radiating conductor element 17 are matched tends to increase. However, an increase in the distance dimension between the parasitic conductor element 19 and the radiating conductor element 17 increases the size of the chip antenna 12, making its application to miniature electronic devices difficult.

In contrast, according to this embodiment, the coupling adjusting conductor plate 20 is provided between the radiating conductor element 17 and the parasitic conductor element 19. Therefore, the amount of coupling between the radiating conductor element 17 and the parasitic conductor element 19 can be adjusted by using the coupling adjusting conductor plate 20.

For the chip antenna 12 to function as a patch antenna, it is necessary to provide a ground conductor plate on the side opposite to the parasitic conductor element 19 as viewed from the radiating conductor element 17. In a case where this ground conductor plate is provided to the chip antenna 12, unwanted stray capacitance occurs between the ground conductor, and the radiating conductor element 17, the coupling adjusting conductor plate 20, the via-holes 18 and 21, and the like, and the match with the strip line 5 that serves as a feed line tends to be lost. For this reason, in this embodiment, the chip antenna 12 is not provided with a ground conductor plate, and the mother substrate 2 is provided with the ground conductor plate 6, 7.

To investigate the effect of omitting a ground conductor plate from the chip antenna 12 in this way, the frequency characteristics of reflectivity (return loss) and antenna gain were measured for a case where a ground conductor plate is omitted (first embodiment), and a case where a ground conductor plate is provided (first comparative example). The results are illustrated in FIGS. 9 and 10.

The thickness dimension of the mother substrate 2 was set to about 0.2 mm, and the thickness dimension of the chip antenna 12 was set to about 0.4 mm. The length dimension L3 of the radiating conductor element 17 was set to about 0.775 mm, and its width dimension L4 was set to about 0.5 mm. The length dimension L5 of the parasitic conductor element 19 was set to about 0.725 mm, and its width dimension L6 was set to about 1.55 mm. The length dimension L7 of the coupling adjusting conductor plate 20 was set to about 0.35 mm, and its width dimension L8 was set to about 1.55 mm. The diameter of the via-holes 18 and 21 was set to about 0.15 mm. In the first comparative example, a ground conductor plate parallel to the XY-plane is placed at a position located closer to the front side 13A than the back side 13B of the chip antenna 12 by about 50 μm. Also, the ground conductor plate is provided over substantially the entire surface except around the via-hole 18.

Figure 9:
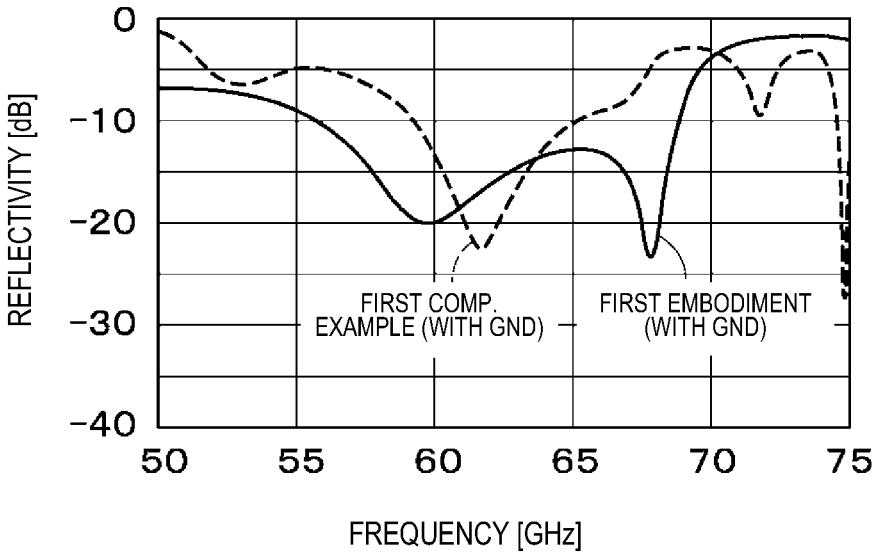
FIG. 9 is a characteristic diagram illustrating the frequency characteristics of reflectivity, for each of the first exemplary embodiment and a first comparative example.

From the results in FIG. 9, it is appreciated that in the case of this embodiment in which the chip antenna 12 is not provided with a ground conductor plate, the frequency bandwidth over which the reflectivity is not more than −10 dB is about 13.2 GHz. In contrast, in the case of the first comparative example in which the chip antenna 12 is provided with a ground conductor plate, the frequency bandwidth over which the reflectivity is not more than −10 dB is about 6.2 GHz, thus decreasing by approximately 53% in comparison to this embodiment.

Figure 10:
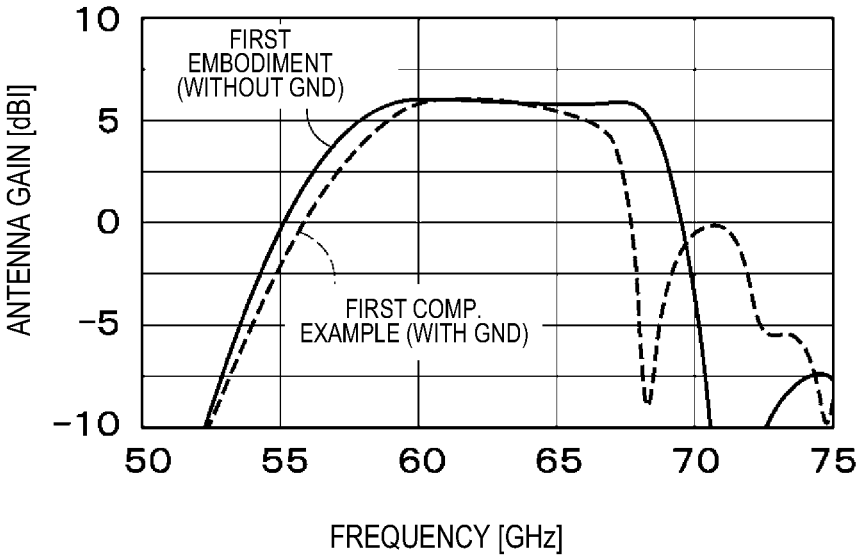
FIG. 10 is a characteristic diagram illustrating the frequency characteristics of antenna gain, for each of the first embodiment and the first comparative example.

From the results in FIG. 10, it is appreciated that in the case of this embodiment in which the chip antenna 12 is not provided with a ground conductor plate, the maximum antenna gain is about 6 dBi, and the 1-dB width of antenna gain, that is, the width of the frequency range for a 1-dB drop from the maximum antenna gain, is about 10.6 GHz. In contrast, in the case of the first comparative example in which the chip antenna 12 is provided with a ground conductor plate, although the maximum antenna gain increases by about 0.1 dB from that in this embodiment, the 1-dB width of antenna gain is about 6.8 GHz, thus decreasing by approximately 36% in comparison to this embodiment.

As described above, according to this embodiment, the chip antenna 12 is not provided with a ground conductor plate. Thus, the matching with the strip line 5 can be enhanced, thereby increasing the bandwidth of reflectivity and antenna gain.

In this way, according to this embodiment, the coupling adjusting conductor plate 20 partially covers the area where the radiating conductor element 17 and the parasitic conductor element 19 overlap each other, and straddles the radiating conductor element 17 in a direction orthogonal to the direction of the current I that flows in the radiating conductor element 17. Therefore, when the radiating conductor element 17 and the parasitic conductor element 19 are electromagnetically coupled to each other, the strength of the electromagnetic coupling can be adjusted by using the coupling adjusting conductor plate 20, thereby increasing the frequency range over which matching is obtained between the strip line 5 and the radiating conductor element 17.

Since the LGA 22 including the plurality of flat electrode pads 23 to 25 is provided on the back side 13B of the laminated body 13, for example, by soldering the LGA 22 onto the mother substrate 2 side, the chip antenna 12 can be joined and fixed to the mother substrate 2. In addition, since the radiating conductor element 17 is connected to the strip line 5 of the mother substrate 2 via the first flat electrode pad 23 of the LGA 22, electric power can be fed via the first flat electrode pad 23. Moreover, the match between the mother substrate 2 and the chip antenna 12 can be achieved by adjusting the placement and shapes of the first to third flat electrode pads 23 to 25 as appropriate. If it is not possible to obtain a complete match through such adjustments, appropriate adjustments can be made by adjusting the diameter, shape, and placement of the via-holes 18 and 21 within the laminated body 13, the shapes, sizes, and placement of the radiating conductor element 17, parasitic conductor element 19, and coupling adjusting conductor plate 20, the thicknesses and layer structure of the insulating layers 14 to 16 of the laminated body 13, and so on.

Since the laminated body 13 is not provided with a ground conductor plate, no stray capacitance occurs between the radiating conductor element 17 and the like, and the ground conductor plate. Therefore, a decrease in matching due to stray capacitance can be suppressed, thereby increasing the bandwidth of reflectivity and antenna gain as compared with the case where the laminated body 13 is provided with a ground conductor plate.

Since the coupling adjusting conductor plate 20 and the second and third flat electrode pads 24 and 25 are provided to the laminated body 13, the both end sides of the coupling adjusting conductor plate 20 can be easily connected to the frontside ground conductor plate 6 via the second and third flat electrode pads 24 and 25 by using the via-holes 21 that penetrate the insulating layers 15 and 16 of the laminated body 13. Therefore, the potential of the coupling adjusting conductor plate 20 can be stabilized, and also the electrical characteristics of the coupling adjusting conductor plate 20 can be made symmetrical with respect to the Y-axis direction, thereby suppressing occurrence of stray capacitance, unwanted resonance phenomenon, and so on as compared with the case where only one end side of the coupling adjusting conductor plate 20 is connected to the frontside ground conductor plate 6.

The radiating conductor element 17, the parasitic conductor element 19, and the coupling adjusting conductor plate 20 are provided to the laminated body 13 in which the plurality of insulating layers 14 to 16 are laminated. Therefore, by providing the parasitic conductor element 19, the coupling adjusting conductor plate 20, and the radiating conductor element 17 sequentially on the front sides of the insulating layers 14 to 16 that are different from each other, the parasitic conductor element 19, the coupling adjusting conductor plate 20, and the radiating conductor element 17 can be easily placed at different positions with respect to the thickness direction of the laminated body 13. As a result, application to the mass production process is facilitated, thereby improving productivity for the chip antenna 12. Also, variations in characteristics among individual antennas can be reduced.

Further, the mother substrate 2 is provided with the strip line 5 including the frontside ground conductor plate 6, the backside ground conductor plate 7, and the strip conductor 8. Therefore, by connecting the strip conductor 8 to the first flat electrode pad 23 through the connecting aperture 6A, electric power can be fed from the strip line 5 to the radiating conductor element 17. Also, by joining the frontside ground conductor plate 6 to the second and third flat electrode pads 24 and 25, the both end sides of the coupling adjusting conductor plate 20 can be connected to the ground.

Figure 11:
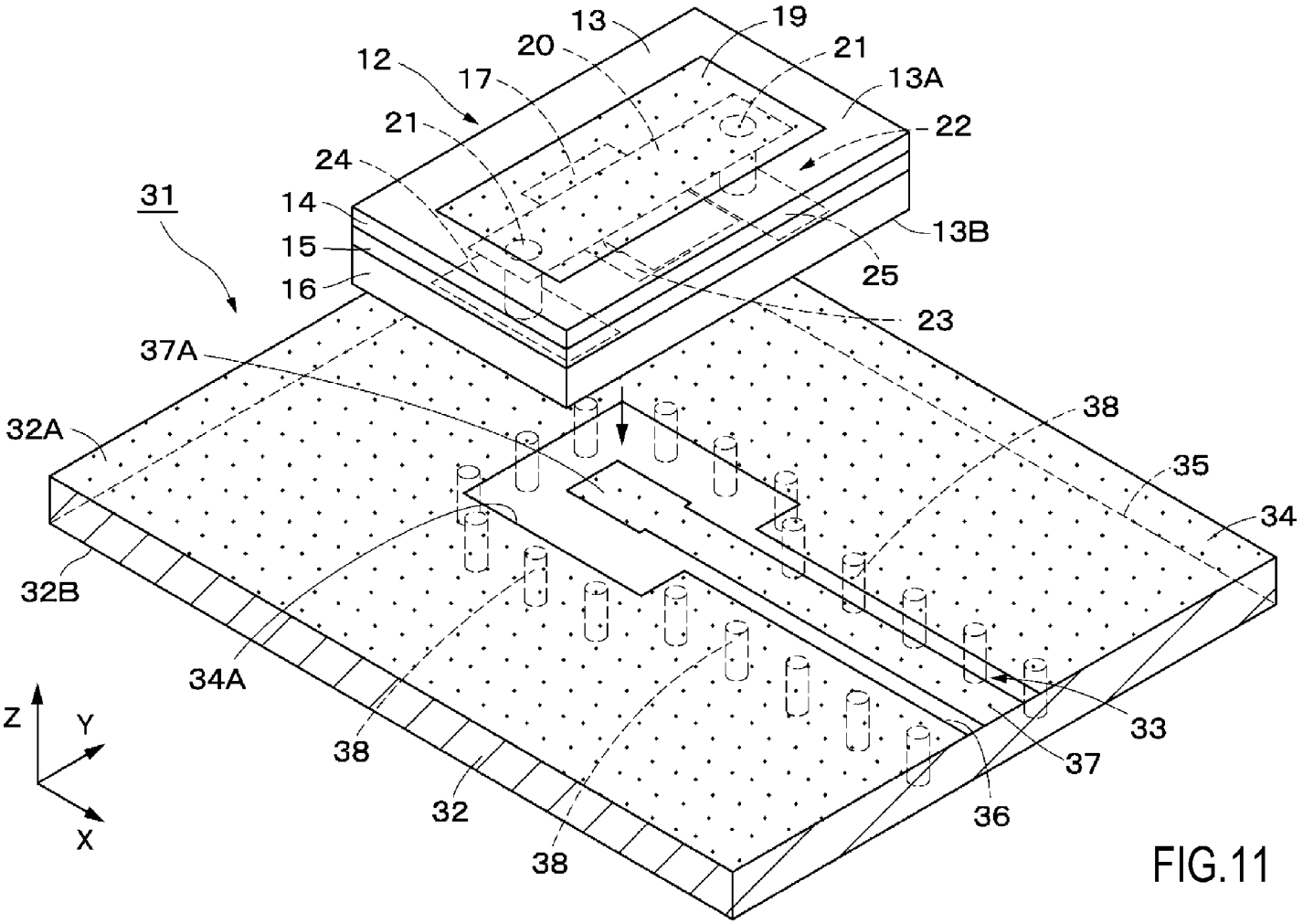
FIG. 11 is a perspective view illustrating an antenna device according to a second exemplary embodiment in a state in which a mother substrate and a chip antenna are separated from each other.
Figure 12:
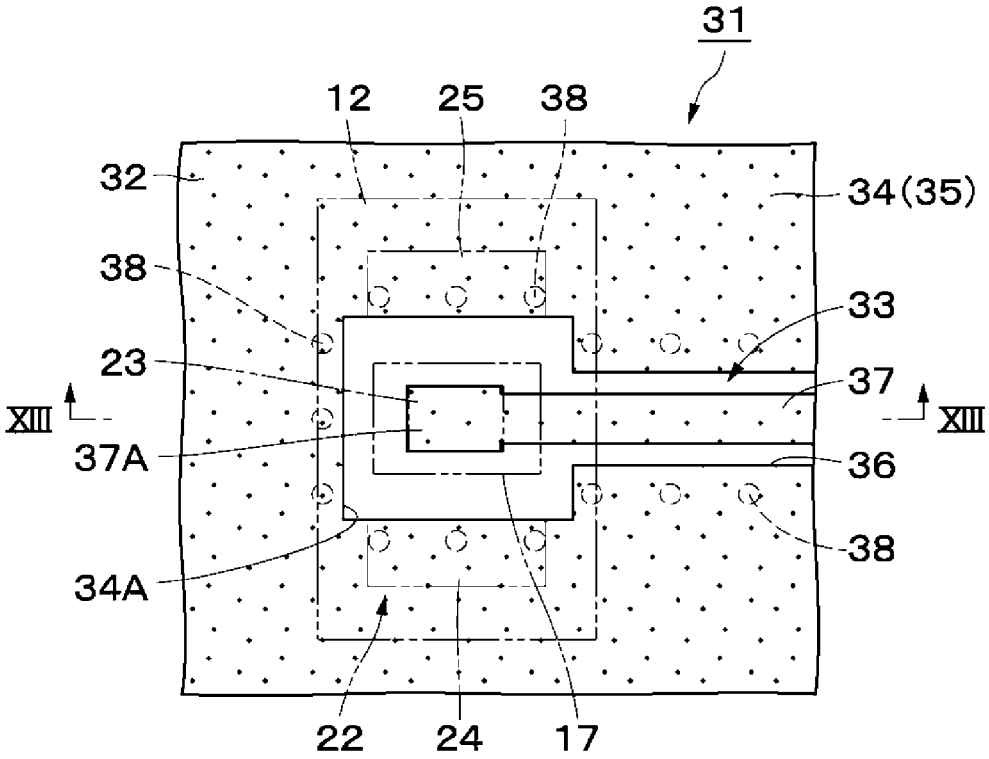
FIG. 12 is a plan view illustrating the main part of the antenna device according to the second exemplary embodiment.
Figure 13:
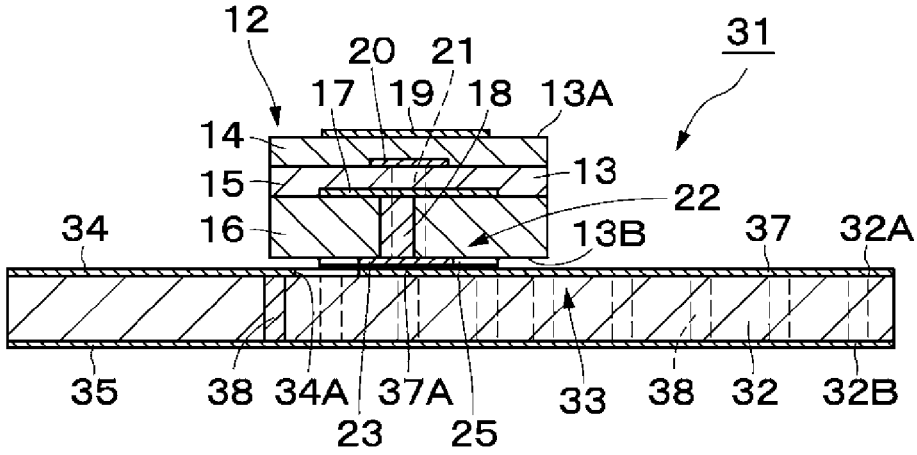
FIG. 13 is a cross-sectional view of the antenna device taken along an arrow XIII-XIII in FIG. 12.

Next, FIGS. 11 to 13 illustrate a second exemplary embodiment. The characteristic feature of this embodiment resides in that a mother substrate 32 is provided with a grounded coplanar line 33, and the grounded coplanar line 33 is connected to the radiating conductor element 17 of the chip antenna 12. In this embodiment, components that are identical to those of the first exemplary embodiment mentioned above are denoted by the identical symbols, and a description of those components is provided above with respect to the first embodiment, and may not repeated here.

An antenna device 31 according to the second embodiment is formed by mounting the chip antenna 12 on the mother substrate 32.

In substantially the same manner as the mother substrate 2 according to the first embodiment, the mother substrate 32 is formed by using an insulating resin material, for example, and extends in parallel to the XY-plane. The chip antenna 12 is mounted on a front side 32A of the mother substrate 32.

The grounded coplanar line 33 forms a feed line for feeding electric power to the radiating conductor element 17 of the chip antenna 12. The grounded coplanar line 33 includes a frontside ground conductor plate 34 provided on the front side 32A of the mother substrate 32, a backside ground conductor plate 35 provided on a back side 32B of the mother substrate 32, a linear gap 36 formed in the frontside ground conductor plate 34 and extending in the X-axis direction, and a strip conductor 37 provided in the gap 36 and extending along the length direction of the gap 36.

In substantially the same manner as the frontside ground conductor plate 6 according to the first exemplary embodiment, the frontside ground conductor plate 34 can be formed by a thin film using a conductive metallic material, and is connected to the ground. The frontside ground conductor plate 34 covers substantially the entire front side 32A of the mother substrate 32. In substantially the same manner as the frontside ground conductor plate 34, the backside ground conductor plate 35 also can be formed by a metallic thin film, is connected to the ground, and can cover substantially the entire back side 32B of the mother substrate 32.

In the central portion of the frontside ground conductor plate 34, for example, a substantially rectangular connecting aperture 34A is provided. The connecting aperture 34A can be formed in substantially the same size and shape as the connecting aperture 6A according to the first exemplary embodiment. The connecting aperture 34A is a substantially oblong or elongated aperture, and has an area larger than the radiating conductor element 17. Therefore, among the outer edges along the four sides of the connecting aperture 34A, the two sides extending in the X-axis direction extend along those long sides of the second and third flat electrode pads 24 and 25 which are located close to the first flat electrode pad 23. The gap 36 that extends linearly in the X-axis direction contiguously connects to the connecting aperture 34A.

The backside ground conductor plate 35 is electrically connected to the frontside ground conductor plate 34 by a plurality of via-holes 38. The via-holes 38 are each formed as a substantially cylindrical conductor that penetrates the mother substrate 32, and extend in the Z-axis direction. The via-holes 38 are placed on both sides in the width direction of the gap 36 so as to surround the gap 36, and are placed along the outer edges of the connecting aperture 34A so as to surround the connecting aperture 34A.

The strip conductor 37 can be made of, for example, substantially the same conductive metallic material as the frontside ground conductor plate 34, and can be formed on the front side 32A of the mother substrate 32. The strip conductor 37 is located in the center portion in the width direction of the gap 36, and formed substantially in the shape of a narrow strip extending in the X-axis direction. The strip conductor 37 is not in contact with the frontside ground conductor plate 34 owing to the gap 36. The grounded coplanar line 33 is formed in line symmetry with respect to a line passing through the center position in the width direction and parallel to the X-axis.

An end of the strip conductor 37 serves as a joint 37A. The joint 37A is located in the central portion of the connecting aperture 34A and formed in substantially the same shape as the first flat electrode pad 23 of the chip antenna 12. The joint 37A is placed at a position facing the first flat electrode pad 23 of the chip antenna 12, and is joined to the first flat electrode pad 23 by a method of joining such as soldering. Thus, the strip conductor 37 is electrically connected to the radiating conductor element 17 of the chip antenna 12.

On the other hand, the area of the frontside ground conductor plate 34 which is located on both sides in the width direction across the connecting aperture 34A is joined to the second and third flat electrode pads 24 and 25. Thus, the both end sides of the coupling adjusting conductor plate 20 of the chip antenna 12 are connected to the ground via the second and third flat electrode pads 24 and 25.

When joining the chip antenna 12 to the mother substrate 32 by reflow soldering or the like, for example, a self-alignment effect is exerted among the first to third flat electrode pads 23 to 25, the joint 37A of the strip conductor 37A, and the frontside ground conductor plate 34.

In this way, in this embodiment as well, substantially the same operational effect as the first exemplary embodiment can be obtained. In particular, in this embodiment, the grounded coplanar line 33 is connected to the radiating conductor element 17. Thus, the mother substrate 32 made up of a single layer can be used. Therefore, as compared with the strip line 5 according to the first exemplary embodiment, the configuration of the grounded coplanar line 33 can be simplified, thereby reducing manufacturing cost. Moreover, the grounded coplanar line 33 commonly used in high-frequency circuits is used, thus providing improved connectivity with other high-frequency circuits.

Figure 14:
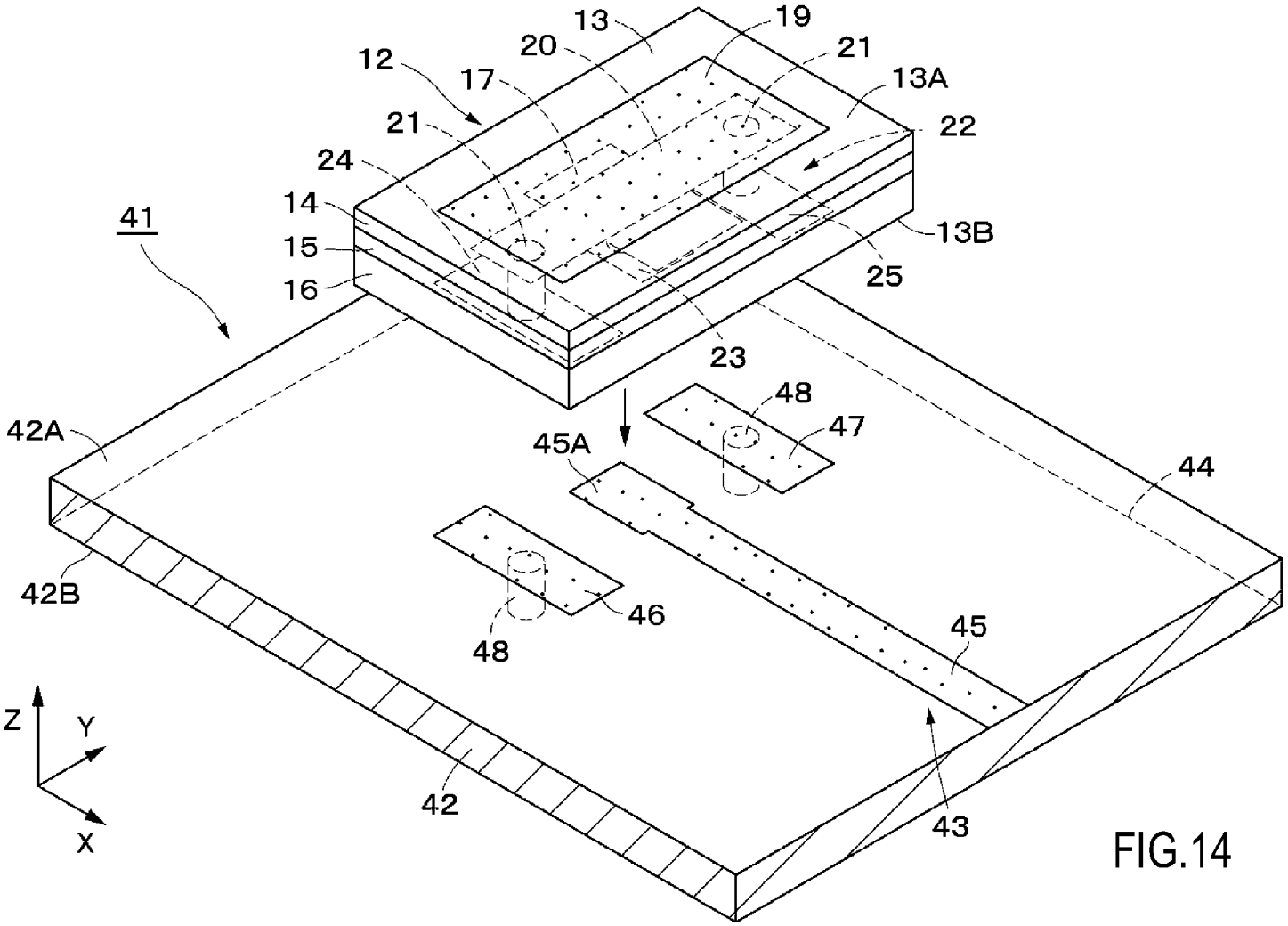
FIG. 14 is a perspective view illustrating an antenna device according to a third exemplary embodiment in a state in which a mother substrate and a chip antenna are separated from each other.
Figure 15:
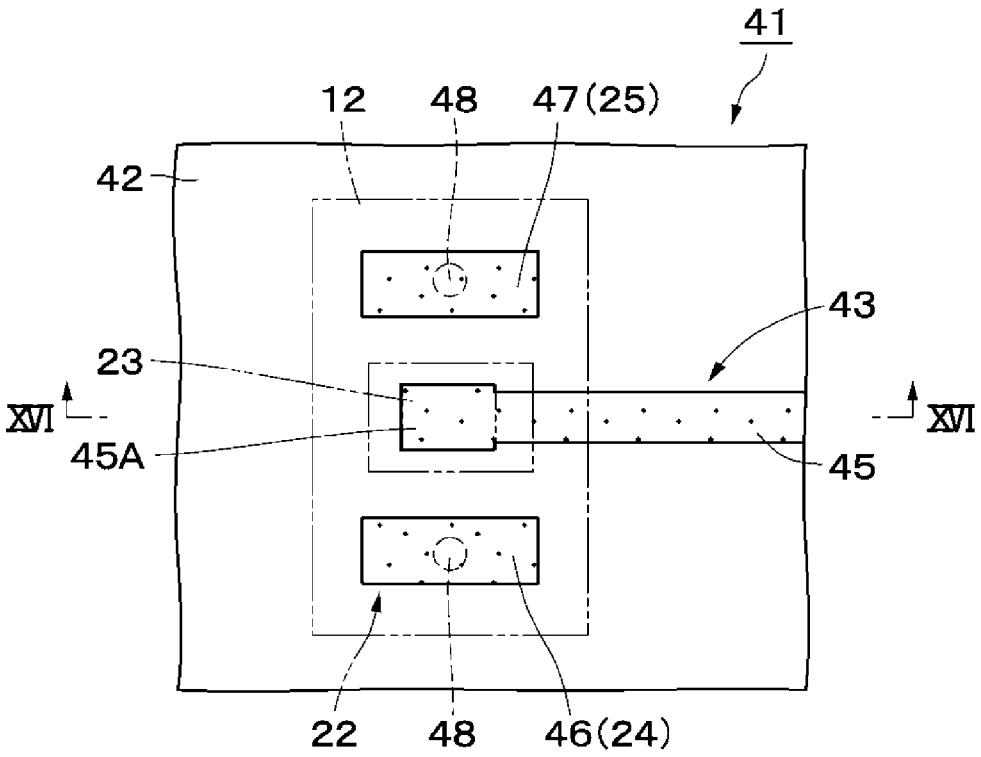
FIG. 15 is a plan view illustrating the main part of the antenna device according to the third exemplary embodiment.
Figure 16:
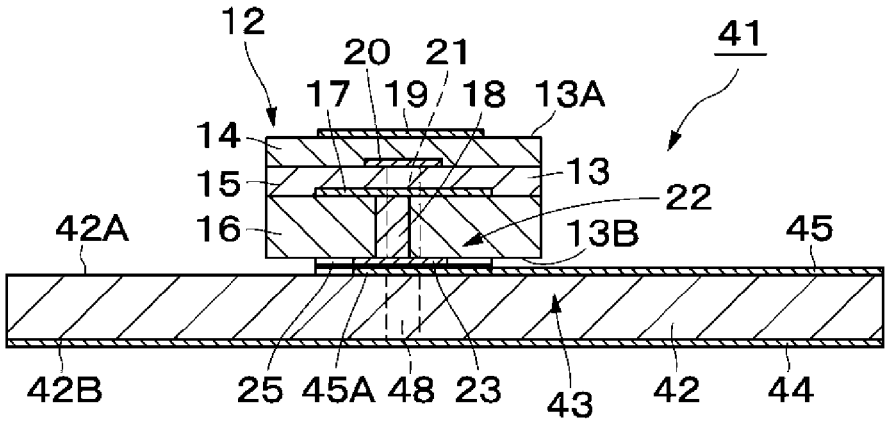
FIG. 16 is a cross-sectional view of the antenna device taken along an arrow XVI-XVI in FIG. 15.
Figure 17:
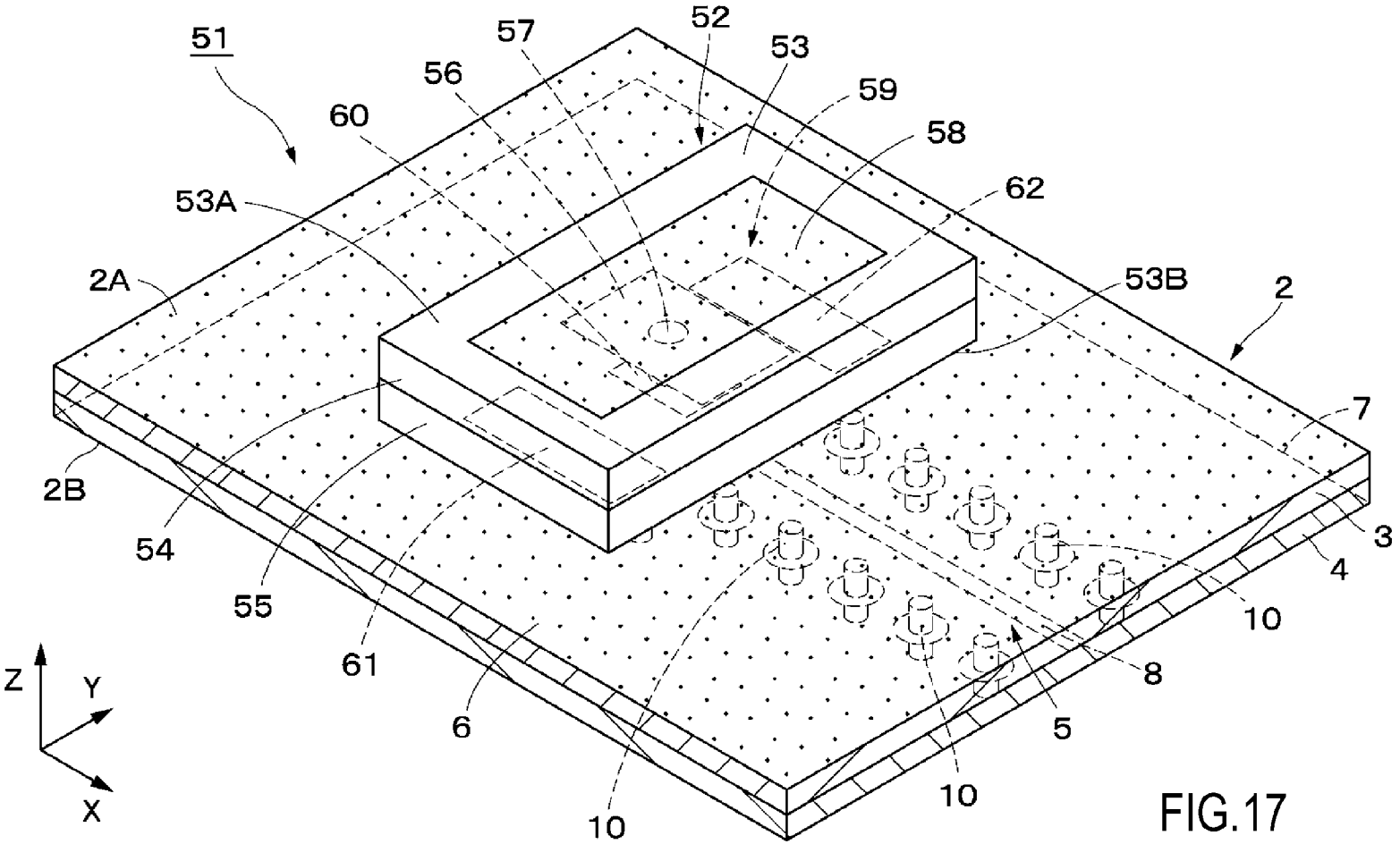
FIG. 17 is a perspective view illustrating an antenna device according to a fourth exemplary embodiment.
Figure 18:
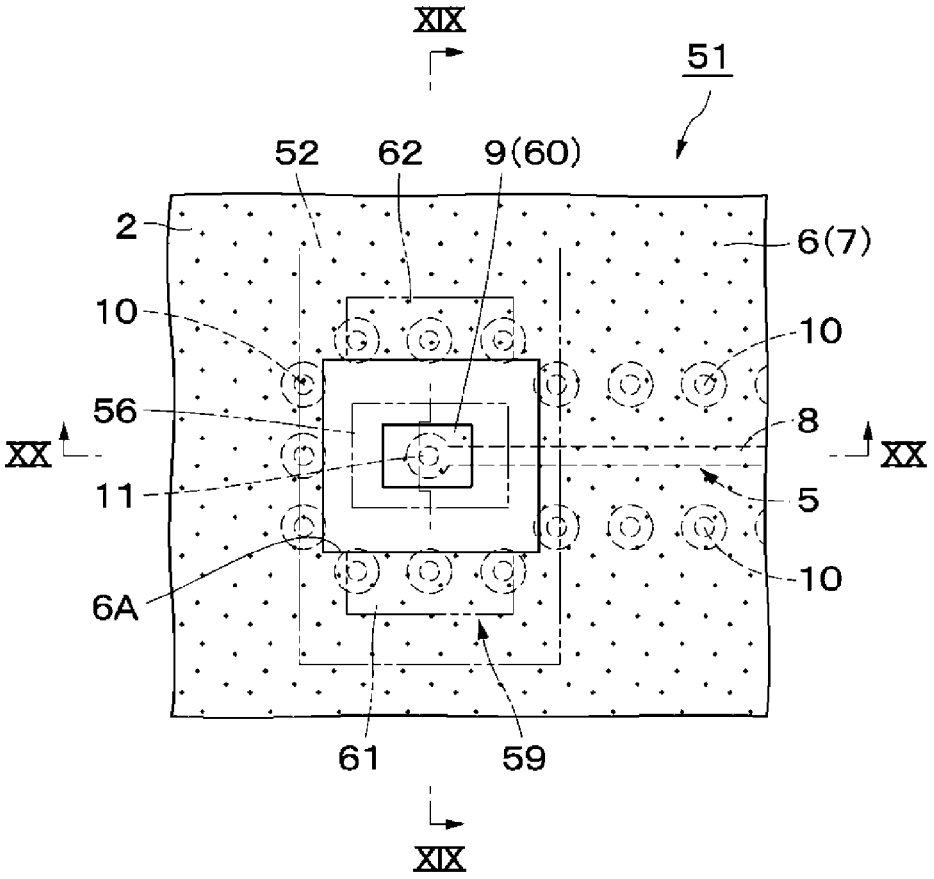
FIG. 18 is a plan view illustrating the main part of the antenna device according to the fourth exemplary embodiment.
Figure 19:
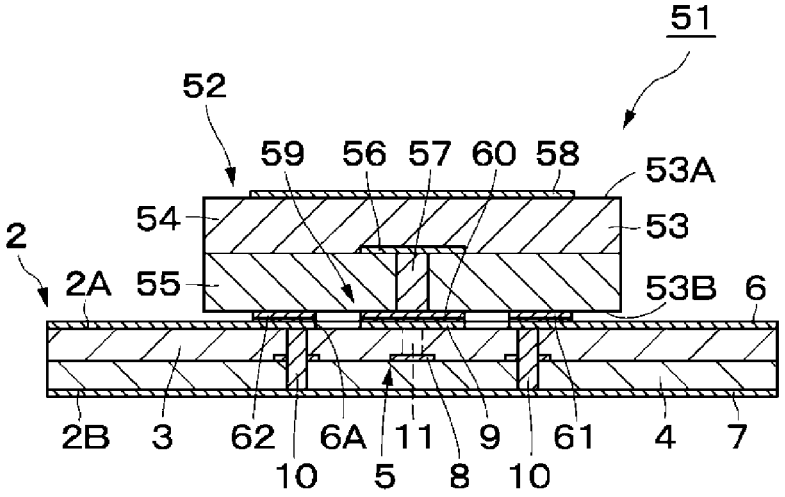
FIG. 19 is a cross-sectional view of the antenna device taken along an arrow XIX-XIX in FIG. 18.
Figure 20:
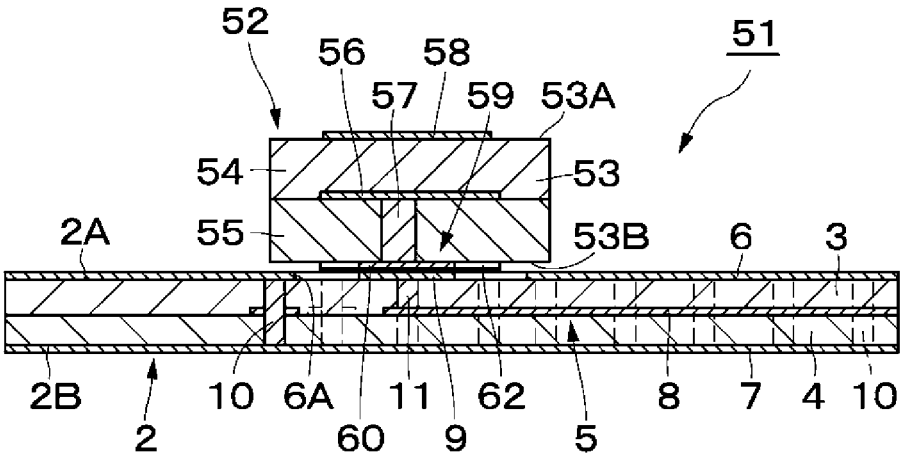
FIG. 20 is a cross-sectional view of the antenna device taken along an arrow XX-XX in FIG. 18.
Figure 21:
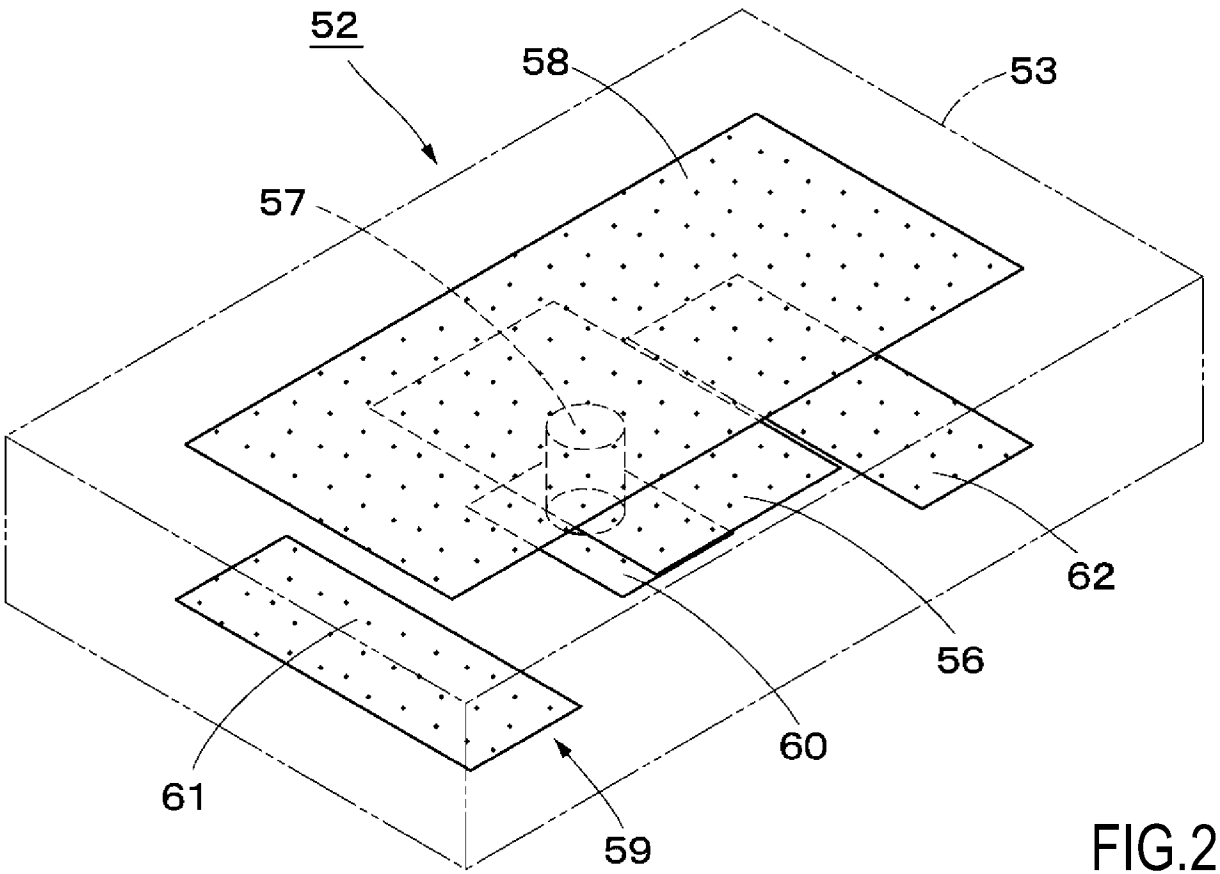
FIG. 21 is a perspective view illustrating a chip antenna in FIG. 17 alone.

Next, FIGS. 14 to 16 illustrate a third exemplary embodiment. The characteristic feature of this embodiment resides in that a mother substrate 42 is provided with a microstrip line 43, and the microstrip line is connected to the radiating conductor element 17 of the chip antenna 12. In this embodiment, components that are identical to those of the first exemplary embodiment mentioned above are denoted by the identical symbols, and a description of those components is provided above with respect to the first exemplary embodiment, and may not repeated here.

An antenna device 41 according to the third exemplary embodiment is formed by mounting the chip antenna 12 on the mother substrate 42.

In substantially the same manner as the mother substrate 2 according to the first exemplary embodiment, the mother substrate 42 can be formed by using an insulating resin material, for example, and extends in parallel to the XY-plane. The chip antenna 12 is mounted on a front side 42A of the mother substrate 42.

The microstrip line 43 forms a feed line for feeding electric power to the radiating conductor element 17 of the chip antenna 12. The microstrip line 43 includes a backside ground conductor plate 44 provided on a back side 42B of the mother substrate 42, and a strip conductor 45 provided on the front side 42A of the mother substrate 42.

In substantially the same manner as the frontside ground conductor plate 6 according to the first exemplary embodiment, the backside ground conductor plate 44 can be formed by a thin film using a conductive metallic material, and can cover substantially the entire back side 42B of the mother substrate 42. The strip conductor 45 can be made of substantially the same conductive metallic material as the frontside ground conductor plate 44, and can be formed substantially in the shape of a narrow strip extending in the X-axis direction. The microstrip line 43 is formed in line symmetry with respect to a line passing through the center position in the width direction and parallel to the X-axis.

An end of the strip conductor 45 serves as a joint 45A that is formed in substantially the same shape as the first flat electrode pad 23 of the chip antenna 12. The joint 45A is provided at a position facing the first flat electrode pad 23 of the chip antenna 12, and is joined to the first flat electrode pad 23 by a method of joining such as soldering. Thus, the strip conductor 45 is electrically connected to the radiating conductor element 17 of the chip antenna 12.

Further, two ground electrode pads 46 and 47 are provided on the front side 42A of the mother substrate 42. The ground electrode pads 46 and 47 are located on both sides in the width direction (Y-axis direction) across the joint 45A of the strip conductor 45. Also, the ground electrode pads 46 and 47 are provided at positions facing the second and third flat electrode pads 24 and 25 of the chip antenna 12, respectively. The ground electrode pads 46 and 47 can be formed in substantially the same size and shape as the second and third flat electrode pads 24 and 25, and are each electrically connected to the backside ground conductor plate 44 via a via-hole 48 that penetrates the mother substrate 42. The ground electrode pads 46 and 47 are joined to the second and third flat electrode pads 24 and 25 of the chip antenna 12, respectively, by a method of joining such as soldering. Thus, the both end sides of the coupling adjusting conductor plate 20 of the chip antenna 12 are connected to the ground via the ground electrode pads 46 and 47, and the like.

The joint 45A of the strip conductor 45 can be formed in substantially the same size and shape as the first flat electrode pad 23. The ground electrode pads 46 and 47 can be formed in substantially the same size and shape as the second and third flat electrode pads 24 and 25. Thus, when joining the chip antenna 12 to the mother substrate 42 by reflow soldering or the like, for example, a self-alignment effect is exerted among the first to third flat electrode pads 23 to 25, the joint 45A of the strip conductor 45, and the ground electrode pads 46 and 47.

In this way, in this embodiment as well, substantially the same operational effect as the first exemplary embodiment can be obtained. In particular, in this embodiment, the microstrip line 43 is connected to the radiating conductor element 17. Thus, as compared with the strip line 5 according to the first exemplary embodiment, the configuration of the microstrip line 43 can be simplified, thereby reducing manufacturing cost. Moreover, the microstrip line 43 commonly used in high-frequency circuits is used, thus providing improved connectivity with other high-frequency circuits.

Next, FIGS. 17 to 21 illustrate a fourth exemplary embodiment. The characteristic feature of this embodiment resides in that the coupling adjusting conductor plate of the chip antenna is omitted. In this embodiment, components that are identical to those of the first exemplary embodiment mentioned above are denoted by the identical symbols, and a description of those components is provided above with respect to the first embodiment, and may not repeated here.

An antenna device 51 according to the fourth exemplary embodiment is formed by mounting a chip antenna 52 on the mother substrate 2.

The chip antenna 52 includes a laminated body 53, a radiating conductor element 56, a parasitic conductor element 58, and a land grid array 59 (hereinafter, referred to as LGA 59).

In substantially the same manner as the laminated body 13 according to the first exemplary embodiment, the laminated body 53 is formed by using, for example, a low temperature co-fired ceramic (LTCC). The laminated body 53 has two insulating layers 54 and 55 laminated in the Z-axis direction from its front side 53A toward its back side 53B. The laminated body 53 is formed in a substantially rectangular parallelepiped shape.

The radiating conductor element 56 can be formed in substantially the same manner as the radiating conductor element 17 according to the first exemplary embodiment. The radiating conductor element 56 faces the connecting aperture 6A of the frontside ground conductor plate 6 at a distance. The radiating conductor element 56 is placed between the insulating layer 54 and the insulating layer 55. Also, the radiating conductor element 56 can be formed with an area smaller than the connecting aperture 6A, and the length dimension in the X-axis direction of the radiating conductor element 56 can be set to a value that is substantially one-half wavelength in electrical length of the high frequency signal used, for example.

Further, a via-hole 57 made of a substantially cylindrical conductor is connected to the radiating conductor element 56 at some midpoint in the X-axis direction. Also, a first flat electrode pad 60 described later is connected to the radiating conductor element 56 via the via-hole 57. The via-hole 57 can be placed so as to be shifted from the middle position of the radiating conductor element 56 with respect to the X-axis direction, for example. The radiating conductor element 56 is electrically connected to the strip conductor 8 via the via-hole 57, the first flat electrode pad 60, and the like.

The parasitic conductor element 58 is formed in substantially the same manner as the parasitic conductor element 19 according to the first embodiment. The parasitic conductor element 58 is located opposite to the joint surface (back side 53B) of the laminated body 53 with the mother substrate 2 as viewed from the radiating conductor element 56, and is placed on the front side 53A of the laminated body 53 (the front side of the insulating layer 54). The parasitic conductor element 58 faces the radiating conductor element 56 at a distance while being insulated from the radiating conductor 56 and the frontside ground conductor plate 6. The parasitic conductor element 58 produces electromagnetic coupling with the radiating conductor element 56.

The LGA 59 includes first to third flat electrode pads 60 to 62 that can be substantially the same as the flat electrode pads 23 to 25 according to the first exemplary embodiment. The LGA 59 is provided on the back side 53B of the laminated body 53. The first flat electrode pad 60 can be provided in the central portion of the back side 53B. The first flat electrode pad 60 can have substantially the same size as the feed electrode pad 9, and can be formed in substantially the same rectangular shape as the feed electrode pad 9.

On the other hand, the second and third flat electrode pads 61 and 62 are placed on both sides in the Y-axis direction across the first flat electrode pad 60. The second and third flat electrode pads 61 and 62 are formed in a substantially oblong or elongated shape whose long side is along the X-axis direction and whose short side is along the Y-axis direction. The second and third flat electrode pads 61 and 62 are spaced apart from each other in the Y-axis direction with substantially the same dimension of distance as the width dimension of the connecting aperture 6A.

The first to third flat electrode pads 60 to 62 can be formed in line symmetry with respect to a line passing through the center position of the first flat electrode pad 60 and parallel to the X-axis, and also can be formed in line symmetry with respect to a line passing through the center position of the first flat electrode pad 60 and parallel to the Y-axis.

The first to third flat electrode pads 60 to 62 are placed facing the feed electrode pad 9 and the edge portion of the connecting aperture 6A of the frontside ground conductor plate 6, and are joined to the feed electrode pad 9 and the frontside ground conductor plate 6 that serves as an electrode by a method of joining such as soldering, for example. Thus, the chip antenna 52 is joined and fixed to the mother substrate 2. Also, the first flat electrode pad 60 is electrically connected to the feed electrode pad 9. Also, when joining the chip antenna 52 to the mother substrate 2 by reflow soldering or the like, for example, a self-alignment effect is exerted among the first to third flat electrode pads 60 to 62, the feed electrode pad 9, and the frontside ground conductor plate 6.

In this way, in this embodiment as well, substantially the same operational effect as the first embodiment can be obtained. In this embodiment, because the coupling adjusting conductor plate is omitted from the chip antenna 52, the bandwidth enhancement effect due to the coupling adjusting conductor plate is not obtained. However, the parasitic conductor element 58 facing the radiating conductor element 56 is provided, thereby achieving bandwidth enhancement due to the parasitic conductor element 58. In addition, the chip antenna 52 can be formed by the laminated body 53 that is made up of two insulating layers 54 and 55, one layer less than the number of insulating layers in the chip antenna 12 according to the first embodiment, thereby reducing manufacturing cost.

Since the chip antenna 52 is joined to the mother substrate 2 by using the LGA 59, as in the first exemplary embodiment, matching between the mother substrate 2 and the chip antenna 52 can be achieved by adjusting the placement and shapes of the first to third flat electrode pads 60 to 62 and the like as appropriate.

In this regard, since the second and third flat electrode pads 61 and 62 of the LGA 59 are not electrically connected to the radiating conductor element 56 or the parasitic conductor element 58, it is also possible to omit the second and third flat electrode pads 61 and 62.

Accordingly, the frequency characteristics of reflectivity (return loss) and antenna gain were measured for a case where the second and third flat electrode pads 61 and 62 are provided (fourth exemplary embodiment), and a case where the second and third flat electrode pads 61 and 62 are omitted (second comparative example). The results are illustrated in FIGS. 22 and 23.

The thickness dimension of the mother substrate 2 was set to about 0.2 mm, and the thickness dimension of the chip antenna 52 was set to about 0.4 mm. The length dimension of the radiating conductor element 56 was set to about 0.775 mm, and its width dimension was set to about 0.5 mm. The length dimension of the parasitic conductor element 58 was set to about 0.725 mm, and its width dimension was set to about 1.55 mm. The diameter of the via-hole 57 was set to about 0.15 mm.

Figure 22:
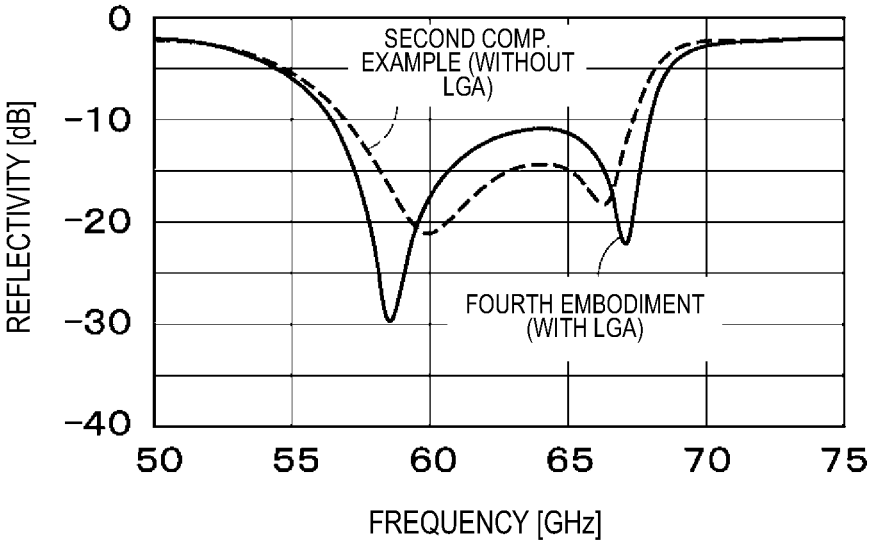
FIG. 22 is a characteristic diagram illustrating the frequency characteristics of reflectivity, for each of the fourth exemplary embodiment and a second comparative example.

From the results in FIG. 22, it is appreciated that in the case of this embodiment in which the chip antenna 52 is provided with the second and third flat electrode pads 61 and 62 (the LGA 59), the frequency bandwidth over which the reflectivity is not more than -10 dB is about 11.5 GHz. In contrast, in the case of the second comparative example in which the second and third flat electrode pads 61 and 62 (the LGA 59) are omitted from the chip antenna 52, the frequency bandwidth over which the reflectivity is not more than −10 dB is about 10.4 GHz, thus decreasing by approximately 10% in comparison to this embodiment.

Figure 23:
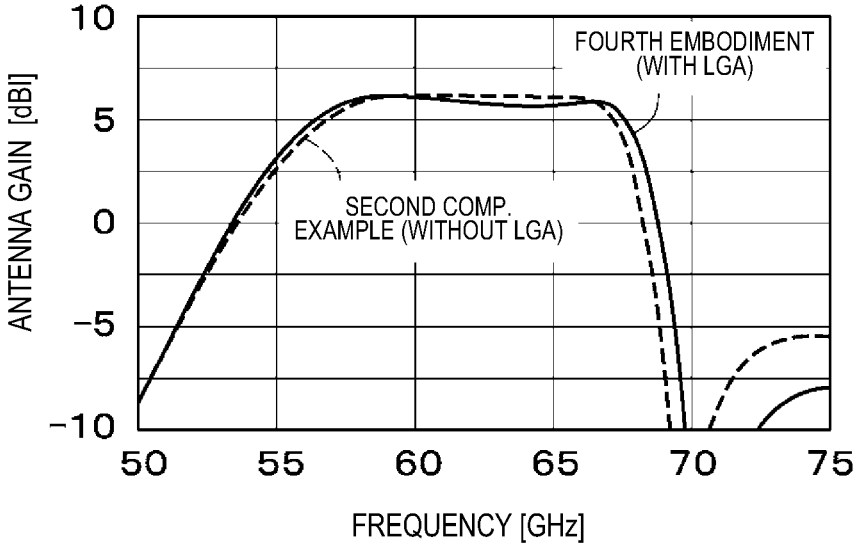
FIG. 23 is a characteristic diagram illustrating the frequency characteristics of antenna gain, for each of the fourth exemplary embodiment and the second comparative example.

From the results in FIG. 23, it is appreciated that in the case of this embodiment in which the chip antenna 52 is provided with the second and third flat electrode pads 61 and 62, the maximum antenna gain is about 6 dBi, and the 1-dB width of antenna gain, that is, the width of the frequency range for a 1-dB drop from the maximum antenna gain, is about 10.9 GHz. In contrast, in the case of the second comparative example in which the second and third flat electrode pads 61 and 62 are omitted from the chip antenna 52, the 1-dB width of antenna gain is about 10.1 GHz, thus decreasing by approximately 7% in comparison to this embodiment.

As can be appreciated from the results in FIGS. 22 and 23, to increase the bandwidth of reflectivity and antenna gain, it is preferable to provide the chip antenna 52 with the second and third flat electrode pads 61 and 62 as in this embodiment.

While the fourth exemplary embodiment is directed to the case of using substantially the same mother substrate 2 as that in the first exemplary embodiment, the mother substrate 32, 42 according to the second or third exemplary embodiment can be used.

While in the above-mentioned embodiments the LGA 22, 59 includes three flat electrode pads 23 to 25, 60 to 62, the LGA 22, 59 may include four or more flat electrode pads.

While the above-mentioned embodiments are directed to the case of the antenna device 1, 31, 41, 51 used for millimeter waves in the 60 GHz band, the embodiments may be applied to an antenna device used for millimeter waves in other frequency ranges, microwaves, or the like.

In embodiments utilizing a coupling adjusting conductor plate, because the coupling adjusting conductor plate partially covers the area where the radiating conductor element and the parasitic conductor element overlap each other, and straddles the radiating conductor element in the direction orthogonal to the direction of the current that flows in the radiating conductor element, when the radiating conductor element and the parasitic conductor element are electromagnetically coupled to each other, the strength of the electromagnetic coupling can be adjusted by using the coupling adjusting conductor plate, thereby increasing the frequency range over which matching is obtained between the feed line and the radiating conductor element.

Specifically, when the length direction of the coupling adjusting conductor plate is made parallel to the direction of the current that flows in the radiating conductor element, by adjusting the length dimension of the coupling adjusting conductor plate, the strength of the magnetic coupling between the radiating conductor element and the parasitic conductor element can be adjusted. Also, when the width direction of the coupling adjusting conductor plate is made orthogonal to the direction of the current that flows in the radiating conductor element, by adjusting the width dimension of the coupling adjusting conductor plate, the resonant frequency of current can be adjusted.

Also, since the land grid array including the plurality of flat electrode pads is provided on the back side of the laminated body, for example, by soldering the land grid array to the mother substrate side, the chip antenna can be joined and fixed to the mother substrate. In addition, since the radiating conductor element is connected to the feed line of the mother substrate via the first flat electrode pad of the land grid array, electric power can be fed via the first flat electrode pad. Moreover, the match between the mother substrate and the chip antenna can be achieved by adjusting the placement or shapes of the first to third flat electrode pads as appropriate. If it is not possible to obtain a complete match through such adjustments, appropriate adjustments can be made by adjusting the diameter or placement of a via-hole disposed within the laminated body, the shapes, sizes, or placement of the radiating conductor element, parasitic conductor element, or coupling adjusting conductor plate, the thicknesses or layer structure of the insulating layers of the laminated body, or so on.

Further, since the laminated body is not provided with a ground conductor plate that covers its entire back side, for example, no unwanted stray capacitance occurs between the radiating conductor element and the like, and the ground conductor plate. Therefore, a decrease in matching due to stray capacitance can be suppressed.

In embodiments in which connection is made between both end sides of the coupling adjusting conductor plate, and connection between the second flat electrode pad and the third flat electrode pad of the land grid array using a columnar conductor that extends in a thickness direction of the laminated body, because connection between the both end sides of the coupling adjusting conductor plate, and the second and third flat electrode pads of the land grid array is made by using the columnar conductor, the coupling adjusting conductor plate and the second and third flat electrode pads can be easily connected by using a via-hole that forms the columnar conductor provided to the laminated body.

In embodiments in which the feed line includes a strip line, where the strip line includes a frontside ground conductor plate provided on a front side of the mother substrate and including a connecting aperture, a backside ground conductor plate provided on a back side of the mother substrate, and a strip conductor provided between the frontside ground conductor plate and the backside ground conductor plate, the strip conductor is connected to the first flat electrode pad via the connecting aperture, and the frontside ground conductor plate is connected to the second flat electrode pad and the third flat electrode pad, since the feed line includes the strip line provided in the mother substrate and including the frontside ground conductor plate, the backside ground conductor plate, and the strip conductor, by connecting the strip conductor to the first flat electrode pad, electric power can be fed from the strip line to the radiating conductor element. Also, by connecting the frontside ground conductor plate to the second and third flat electrode pads, the both end sides of the coupling adjusting conductor plate can be connected to the ground.

In embodiments in which the feed line includes a grounded coplanar line, where the grounded coplanar line includes a frontside ground conductor plate provided on a front side of the mother substrate, a backside ground conductor plate provided on a back side of the mother substrate, a gap including a linear shape that is formed in the frontside ground conductor plate, and a strip conductor provided in the gap and extending along a length direction of the gap, the strip conductor is connected to the first flat electrode pad, and the frontside ground conductor plate is connected to the second flat electrode pad and the third flat electrode pad, because the feed line includes the grounded coplanar line provided in the mother substrate and including the frontside ground conductor plate, the backside ground conductor plate, and the strip conductor provided in the gap of the frontside ground conductor plate, by connecting the strip conductor to the first flat electrode pad, electric power can be fed from the grounded coplanar line to the radiating conductor element. Also, by connecting the frontside ground conductor plate to the second and third flat electrode pads, the both end sides of the coupling adjusting conductor plate can be connected to the ground.

In embodiments in which the antenna device further includes two ground electrode pads provided on a front side of the mother substrate, the feed line includes a microstrip line, the microstrip line including a backside ground conductor plate provided on a back side of the mother substrate, and a strip conductor provided on the front side of the mother substrate, the strip conductor is connected to the first flat electrode pad, and the backside ground conductor plate is connected to the second flat electrode pad and the third flat electrode pad via the two ground electrode pads, because the feed line includes the microstrip line provided in the mother substrate and including the backside ground conductor plate and the strip conductor, by connecting the strip conductor to the first flat electrode pad, electric power can be fed from the microstrip line to the radiating conductor element. Also, since the backside ground conductor plate is connected to the second and third flat electrode pads via the two ground electrode pads provided on the front side of the mother substrate, the both end sides of the coupling adjusting conductor plate can be connected to the ground via the two ground electrode pads.

In embodiments in which the radiating conductor element, the parasitic conductor element, and the coupling adjusting conductor plate are provided at positions different from each other with respect to a thickness direction of the laminated body, because the radiating conductor element, the parasitic conductor element, and the coupling adjusting conductor plate are provided to the laminated body in which the plurality of insulating layers are laminated, by providing the parasitic conductor element, the coupling adjusting conductor plate, and the radiating conductor element, for example, on the front sides of the insulating layers that are different from each other, the parasitic conductor element, the coupling adjusting conductor plate, and the radiating conductor element can be easily placed at different positions with respect to the thickness direction of the laminated body. As a result, application to the mass production process is facilitated, thereby improving productivity for the chip antenna. Also, variations in characteristics among individual antennas can be reduced.

In embodiments of the disclosure that do not include a coupling adjusting conductor plate, because the parasitic conductor element and the radiating conductor element overlap each other, the frequency range over which matching is obtained between the feed line and the radiating conductor element can be increased as compared with the case where the parasitic conductor element is omitted.

Since the land grid array including the plurality of flat electrode pads is provided on the back side of the laminated body, for example, by soldering the land grid array to the mother substrate side, the chip antenna can be joined and fixed to the mother substrate. Also, since the radiating conductor element is connected to the feed line of the mother substrate via the first flat electrode pad of the land grid array, electric power can be fed via the first flat electrode pad. The match between the mother substrate and the chip antenna can be achieved by adjusting the placement or shapes of the plurality of flat electrode pads as appropriate. If it is not possible to obtain a complete match through such adjustments, adjustments can be made by adjusting the diameter or placement of a via-hole disposed within the laminated body, the shapes, sizes, or placement of the radiating conductor element or the like, the thicknesses or layer structure of the insulating layers of the laminated body, or so on.

Further, since the laminated body is not provided with, for example, such a ground conductor plate that covers its entire back side, no unwanted stray capacitance occurs between the radiating conductor element and the like, and the ground conductor plate. Therefore, a decrease in matching due to stray capacitance can be suppressed.

While some exemplary embodiments of the disclosure have been described above, it is to be understood that variations and modifications will be apparent to those skilled in the art without departing from the scope and spirit of the disclosure.

What is claimed is:

1. An antenna device comprising:

a mother substrate including a feed line and a ground; and a chip antenna mounted on the mother substrate, the chip antenna including:

a laminated body including a plurality of insulating layers that are laminated together, a radiating conductor element located inside the laminated body and sandwiched between two of the insulating layers, said radiating conductor element being connected to the feed line of the mother substrate, a parasitic conductor element that is located more toward a front side of the laminated body with respect to the radiating conductor element, and is insulated from the radiating conductor element, a coupling adjusting conductor plate that is placed between the parasitic conductor element and the radiating conductor element, and adjusts an amount of coupling between the parasitic conductor element and the radiating conductor element, and a land grid array provided on a back side of the laminated body and including a plurality of flat electrode pads, said flat electrode pads including a first flat electrode pad, a second flat electrode pad, and a third flat electrode pad, wherein the coupling adjusting conductor plate covers a center part of an area where the parasitic conductor element and the radiating conductor element overlap each other when viewed in a thickness direction of the laminated body, and straddles the radiating conductor element in a direction orthogonal to a direction of a current that flows in the radiating conductor element, a front-side ground conductor plate connected to the ground is provided on a front side of the mother substrate, wherein the front-side ground conductor plate includes a connecting aperture larger than the radiating conductor element, the radiating conductor element is connected to the feed line of the mother substrate at the position of the connecting aperture via the first flat electrode pad of the land grid array, and both end sides of the coupling adjusting conductor plate are connected to the front-side ground conductor plate of the mother substrate via the second flat electrode pad and the third flat electrode pad of the land grid array.

2. The antenna device according to claim 1, wherein connection between the both end sides of the coupling adjusting conductor plate, and the second flat electrode pad and the third flat electrode pad of the land grid array is made by using a columnar conductor that extends in the thickness direction of the laminated body.

3. The antenna device according to claim 1, wherein:

the feed line includes a strip line, said strip line including:

a backside ground conductor plate provided on a back side of the mother substrate, and a strip conductor provided between the frontside ground conductor plate and the backside ground conductor plate;

the strip conductor is connected to the first flat electrode pad via the connecting aperture; and the frontside ground conductor plate is connected to the second flat electrode pad and the third flat electrode pad.

4. The antenna device according to claim 2, wherein:

the feed line includes a strip line, said strip line including:

a frontside ground conductor plate provided on a front side of the mother substrate and including a connecting aperture, a backside ground conductor plate provided on a back side of the mother substrate, and a strip conductor provided between the frontside ground conductor plate and the backside ground conductor plate;

the strip conductor is connected to the first flat electrode pad via the connecting aperture; and the frontside ground conductor plate is connected to the second flat electrode pad and the third flat electrode pad.

5. The antenna device according to claim 1, wherein:

the feed line includes a grounded coplanar line, said grounded coplanar line including:

a frontside ground conductor plate provided on a front side of the mother substrate, a backside ground conductor plate provided on a back side of the mother substrate, a gap including a linear shape that is formed in the frontside ground conductor plate, and a strip conductor provided in the gap and extending along a length direction of the gap;

the strip conductor is connected to the first flat electrode pad; and the frontside ground conductor plate is connected to the second flat electrode pad and the third flat electrode pad.

6. The antenna device according to claim 2, wherein:

the feed line includes a grounded coplanar line, said grounded coplanar line including:

a frontside ground conductor plate provided on a front side of the mother substrate, a backside ground conductor plate provided on a back side of the mother substrate, a gap including a linear shape that is formed in the frontside ground conductor plate, and a strip conductor provided in the gap and extending along a length direction of the gap;

the strip conductor is connected to the first flat electrode pad; and the frontside ground conductor plate is connected to the second flat electrode pad and the third flat electrode pad.

7. The antenna device according to claim 1, further comprising:

two ground electrode pads provided on a front side of the mother substrate, wherein the feed line includes a microstrip line, said microstrip line including:

a backside ground conductor plate provided on a back side of the mother substrate, and a strip conductor provided on the front side of the mother substrate, the strip conductor is connected to the first flat electrode pad, and the backside ground conductor plate is connected to the second flat electrode pad and the third flat electrode pad via the two ground electrode pads.

8. The antenna device according to claim 2, further comprising:

two ground electrode pads provided on a front side of the mother substrate, wherein the feed line includes a microstrip line, said microstrip line including:

a backside ground conductor plate provided on a back side of the mother substrate, and a strip conductor provided on the front side of the mother substrate, the strip conductor is connected to the first flat electrode pad, and the backside ground conductor plate is connected to the second flat electrode pad and the third flat electrode pad via the two ground electrode pads.

9. The antenna device according to claim 1, wherein the radiating conductor element, the parasitic conductor element, and the coupling adjusting conductor plate are provided at positions different from each other with respect to the thickness direction of the laminated body.

10. The antenna device according to claim 2, wherein the radiating conductor element, the parasitic conductor element, and the coupling adjusting conductor plate are provided at positions different from each other with respect to the thickness direction of the laminated body.

11. The antenna device according to claim 3, wherein the radiating conductor element, the parasitic conductor element, and the coupling adjusting conductor plate are provided at positions different from each other with respect to the thickness direction of the laminated body.

12. The antenna device according to claim 4, wherein the radiating conductor element, the parasitic conductor element, and the coupling adjusting conductor plate are provided at positions different from each other with respect to the thickness direction of the laminated body.

13. The antenna device according to claim 5, wherein the radiating conductor element, the parasitic conductor element, and the coupling adjusting conductor plate are provided at positions different from each other with respect to the thickness direction of the laminated body.

14. The antenna device according to claim 6, wherein the radiating conductor element, the parasitic conductor element, and the coupling adjusting conductor plate are provided at positions different from each other with respect to the thickness direction of the laminated body.

15. The antenna device according to claim 7, wherein the radiating conductor element, the parasitic conductor element, and the coupling adjusting conductor plate are provided at positions different from each other with respect to the thickness direction of the laminated body.

16. The antenna device according to claim 8, wherein the radiating conductor element, the parasitic conductor element, and the coupling adjusting conductor plate are provided at positions different from each other with respect to the thickness direction of the laminated body.

17. An antenna device comprising:

a mother substrate including a feed line and an electrode; and a chip antenna mounted on the mother substrate, said chip antenna including:

a laminated body including a plurality of insulating layers that are laminated together, a radiating conductor element located inside the laminated body and sandwiched between two of the insulating layers, said radiating conductor element being connected to the feed line of the mother substrate, a parasitic conductor element that is located more toward a front side of the laminated body with respect to the radiating conductor element, and is insulated from the radiating conductor element, a coupling adjusting conductor plate, and a land grid array provided on a back side of the laminated body and including a plurality of flat electrode pads, said flat electrode pads including a first flat electrode pad and a flat electrode pad other than the first flat electrode pad, wherein a front-side ground conductor plate connected to the ground is provided on a front side of the mother substrate, wherein the front-side ground conductor plate includes a connecting aperture larger than the radiating conductor element, and wherein the flat electrode pad other than the first flat electrode pad of the land grid array is joined to the front-side ground conductor plate of the mother substrate, the radiating conductor element is connected to the feed line of the mother substrate at the position of the connecting aperture via the first flat electrode pad of the land grid array, the flat electrode pad of the land grid array is joined to the electrode of the mother substrate, and the coupling adjusting conductor plate covers a center part of an area where the parasitic conductor element and the radiating conductor element overlap each other when viewed in a thickness direction of the laminated body.

* * * * *